US012163719B2

(12) United States Patent
Tadhani et al.

(10) Patent No.: US 12,163,719 B2
(45) Date of Patent: Dec. 10, 2024

(54) COMBINATION BAGGER

(71) Applicant: Ice House America, LLC, S. Moultrie, GA (US)

(72) Inventors: Manoj Tadhani, Peachtree City, GA (US); Kevin Coppock, Moultrie, GA (US); Nicholas Wilcox, Thomasville, GA (US)

(73) Assignee: ICE HOUSE AMERICA, LLC, Moultrie, GA (US)

( * ) Notice: Subject to any disclaimer, the term of this patent is extended or adjusted under 35 U.S.C. 154(b) by 26 days.

(21) Appl. No.: 17/742,760

(22) Filed: May 12, 2022

(65) Prior Publication Data

US 2023/0366604 A1 Nov. 16, 2023

(51) Int. Cl.
*F25C 5/20* (2018.01)
*F25C 5/04* (2006.01)

(52) U.S. Cl.
CPC ..... *F25C 5/20* (2018.01); *F25C 5/046* (2013.01)

(58) Field of Classification Search
CPC ..... F25C 5/20; F25C 5/046
USPC ..... 62/457.2, 344
See application file for complete search history.

(56) References Cited

U.S. PATENT DOCUMENTS 3,592,366 A * 7/1971 Markley ..... F25C 1/22 222/242
3,798,923 A * 3/1974 Pink ..... F25C 5/22 221/265
3,858,765 A * 1/1975 Landers ..... F25C 5/20 222/413
3,918,266 A * 11/1975 Gindy ..... F25C 5/20 62/344
4,856,682 A * 8/1989 Miller ..... F25C 5/24 222/330
4,946,073 A * 8/1990 Brill ..... B67D 1/08 222/430
5,054,654 A * 10/1991 Schroeder ..... F25C 5/20 222/239
5,219,103 A * 6/1993 Carper ..... G01F 11/40 222/413
5,560,221 A * 10/1996 Snelling ..... F25C 5/24 62/460
7,062,892 B2 * 6/2006 Metzger ..... B65B 57/14 53/127
2003/0042267 A1 * 3/2003 Hawkes ..... G07F 11/66 221/2
2003/0218025 A1 * 11/2003 Hawkes ..... F25C 5/24 222/146.6
2005/0258196 A1 * 11/2005 Romanyszyn ..... A23G 9/28 222/410
2006/0174969 A1 * 8/2006 Dalton ..... G07F 13/025 141/114
2008/0022635 A1 * 1/2008 Metzger ..... B65B 1/36 53/469
2020/0393185 A1 * 12/2020 Scalf ..... F25D 23/12

* cited by examiner

*Primary Examiner* — Len Tran
*Assistant Examiner* — Kirstin U Oswald
(74) *Attorney, Agent, or Firm* — Brown & Michaels, PC

(57) ABSTRACT

An inline vending machine for ice and water vending installed within a store wall allowing a user to purchase ice and water without entering the store. At the same time, an additional vending of ice can occur within the store for store use and sale within the store as demanded by customers. Vending to the outside of the building and within the building can occur simultaneously.

13 Claims, 34 Drawing Sheets

130

130

COMBINATION BAGGER

BACKGROUND

The present invention relates to vending units, and more specifically to inline vending units, preferably for dispensing ice and water.

Often times to purchase ice or water, a consumer or user has to enter a store. Most stores are not available for a consumer or user to enter twenty-four hours a day. Free standing ice vending units are available to consumers or users twenty-four hours a day, but are subject to vandalism and theft as there is not a constant present by an employee monitoring the vending unit.

For stores to sell ice within the store, they need to arrange delivery of ice and determine demand in order to maintain a supply with in the store for purchase, which can be difficult to determine.

SUMMARY

According to one embodiment of the present invention, an inline vending machine for ice and water vending installed within a store wall allowing a user to purchase ice and water without entering the store. At the same time, an additional vending of ice can occur within the store for store use and sale within the store as demanded by customers. Vending to the outside of the building and within the building can occur simultaneously.

The inline vending machine of an embodiment of the present invention allows customers to purchase products from outside of a store twenty-four hours a day through a consumer interface. The inline vending machine can be installed as part of a new building construction and sealed to a multitude of service or be retrofitted into existing buildings by removing a portion of the wall. The customer interface of the inline vending machine allows for cash collection and other maintenance items to be conducted securely from inside the store. Additionally, an ice maker and ice bin are present inside the store, which allows the inline vending machine to bag-ice inside the store utilizing and additional incline auger mechanism. An operator can additionally use the same ice bin to vend ice from within the store and bag the ice.

DETAILED DESCRIPTION

Figure 1:
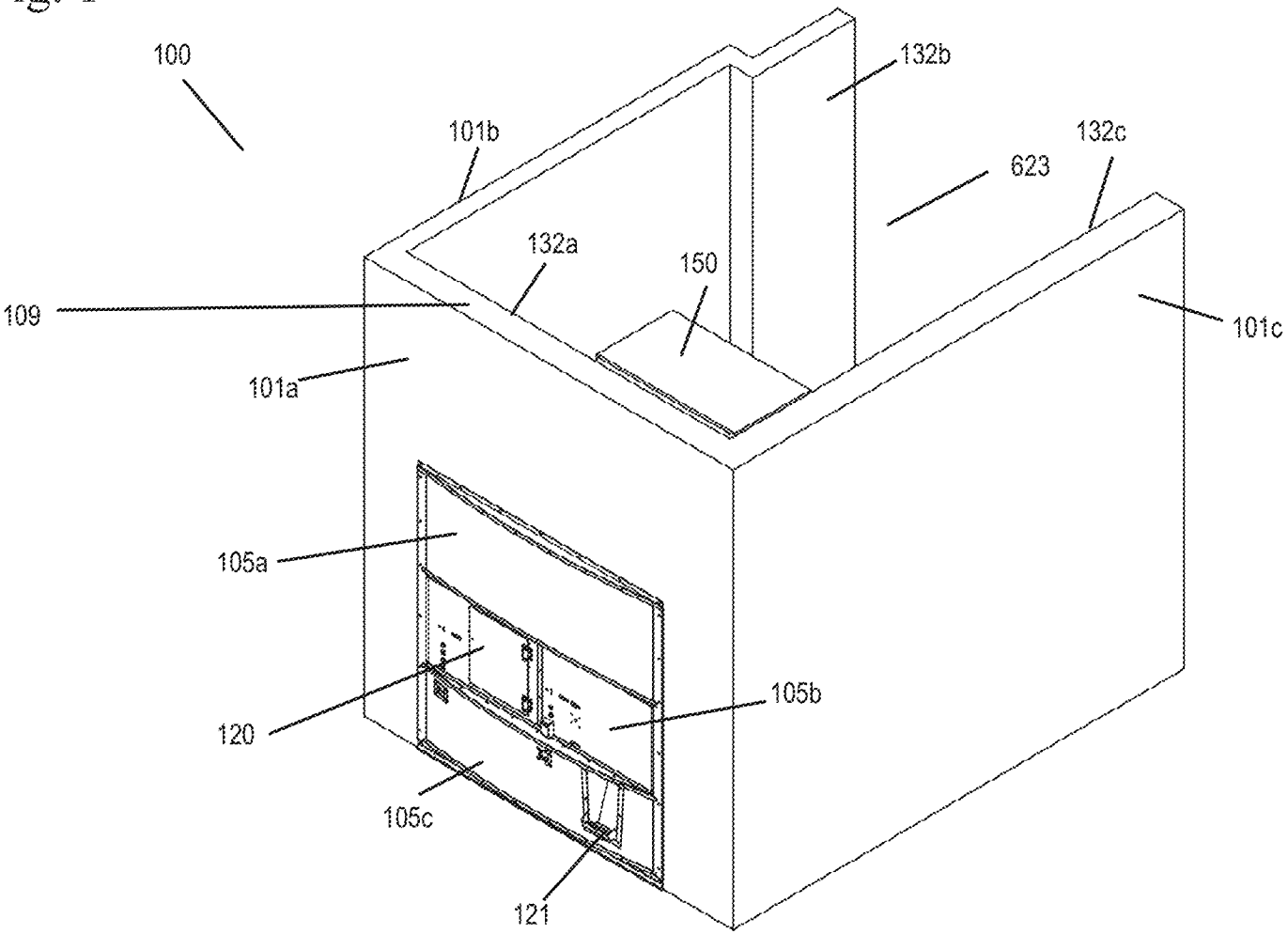
FIG. 1 shows a perspective view of a building with a vending interface.
Figure 2:
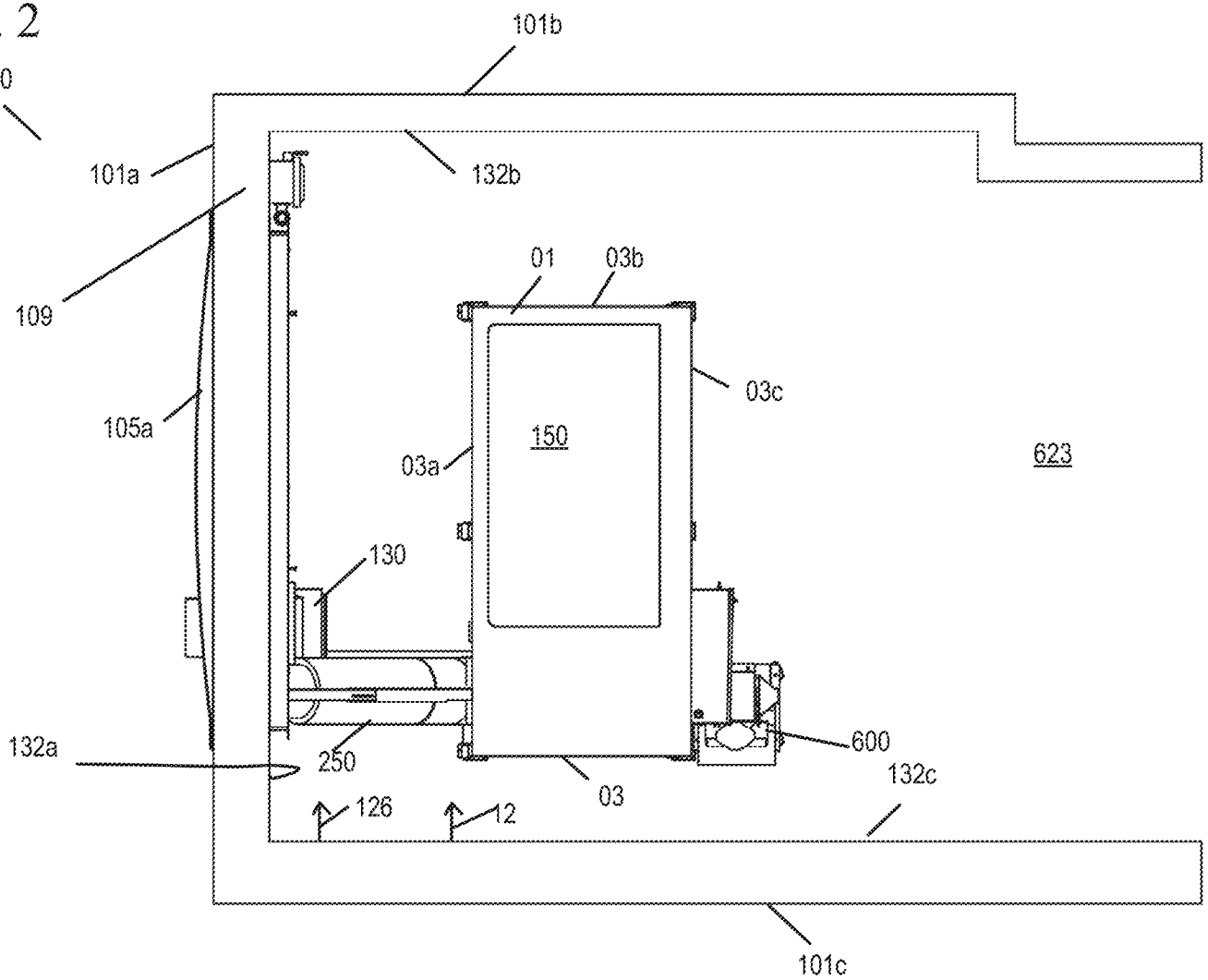
FIG. 2 shows a top down view of the building with vending machinery for ice and water.
Figure 3:
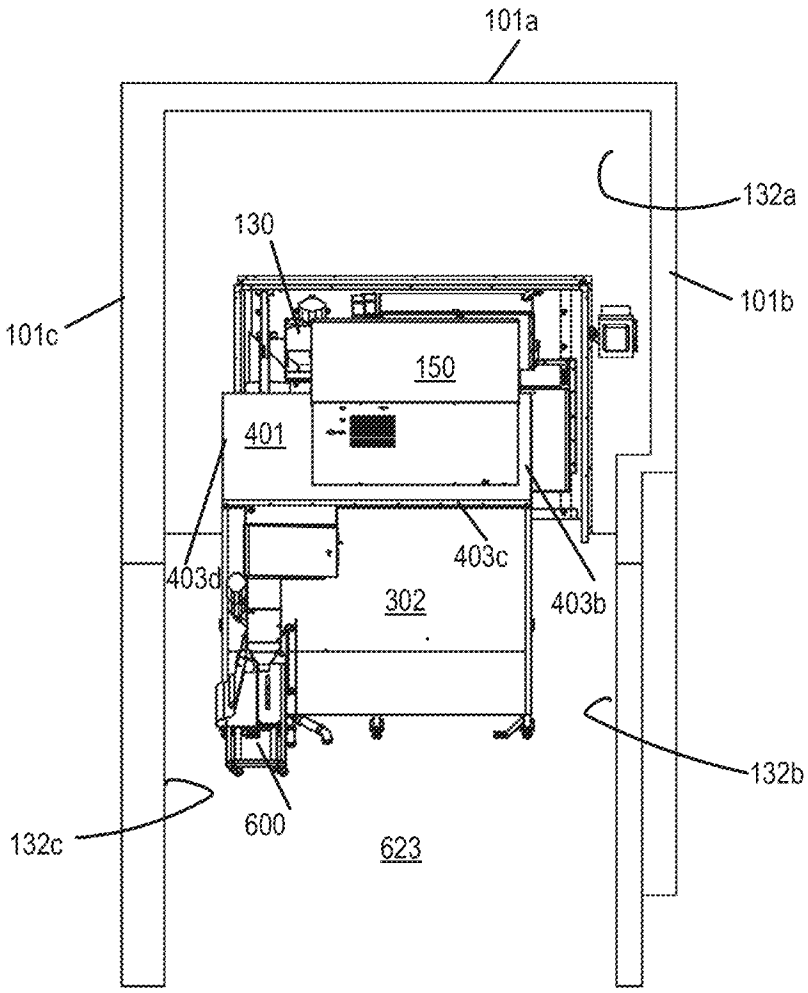
FIG. 3 shows a perspective view of the interior of the building with the vending machinery for vending ice and water.

FIGS. 1-3, 6, 30 and 33 shows an outer store front wall 101*a* with a customer interface 100 outside of a store. In this embodiment, the store includes at least a section in which the outer store front wall 101*a* is connected to a first outer side wall 101*b* and a second outer side wall 101*b* to define an inside area 623 for receiving ice machinery. The inside area 623 is defined by inside side walls 132*b*, 132*b* of outer side walls 101*b*, 101*c* and the inside store front wall 132*a* of the outer store front wall 101*a*. It is noted that the inside area 623 is accessed by entering the store and is preferably cordoned off to be accessed by store staff only, not the general public looking to purchase ice or water.

The store may be any structure in which other goods, besides water and ice are sold, and/or a user or customer can enter. An example of a store may be, but is not limited to, a convenience store, a general merchandise store, a department store or a gas station. The customer interface 100 is set into or inline with the outer store front wall 101*a* using inner wall trim 103 which receives an insulated front wall 109. Surrounding the perimeter of the insulated front wall 109 is an outer wall trim 102 and bottom trim 111 attached to the insulated front wall 109 through a plurality of fasteners 104. Attached to the insulated front wall 109, through a plurality of fasteners 110 is a vendor front back panel 107. The outer wall trim 102, the inner wall trim 103 and the bottom trim 111 provide protection against outer environmental elements entering the inside of the store or the space containing the ice vending machinery inside the store.

Figure 4:
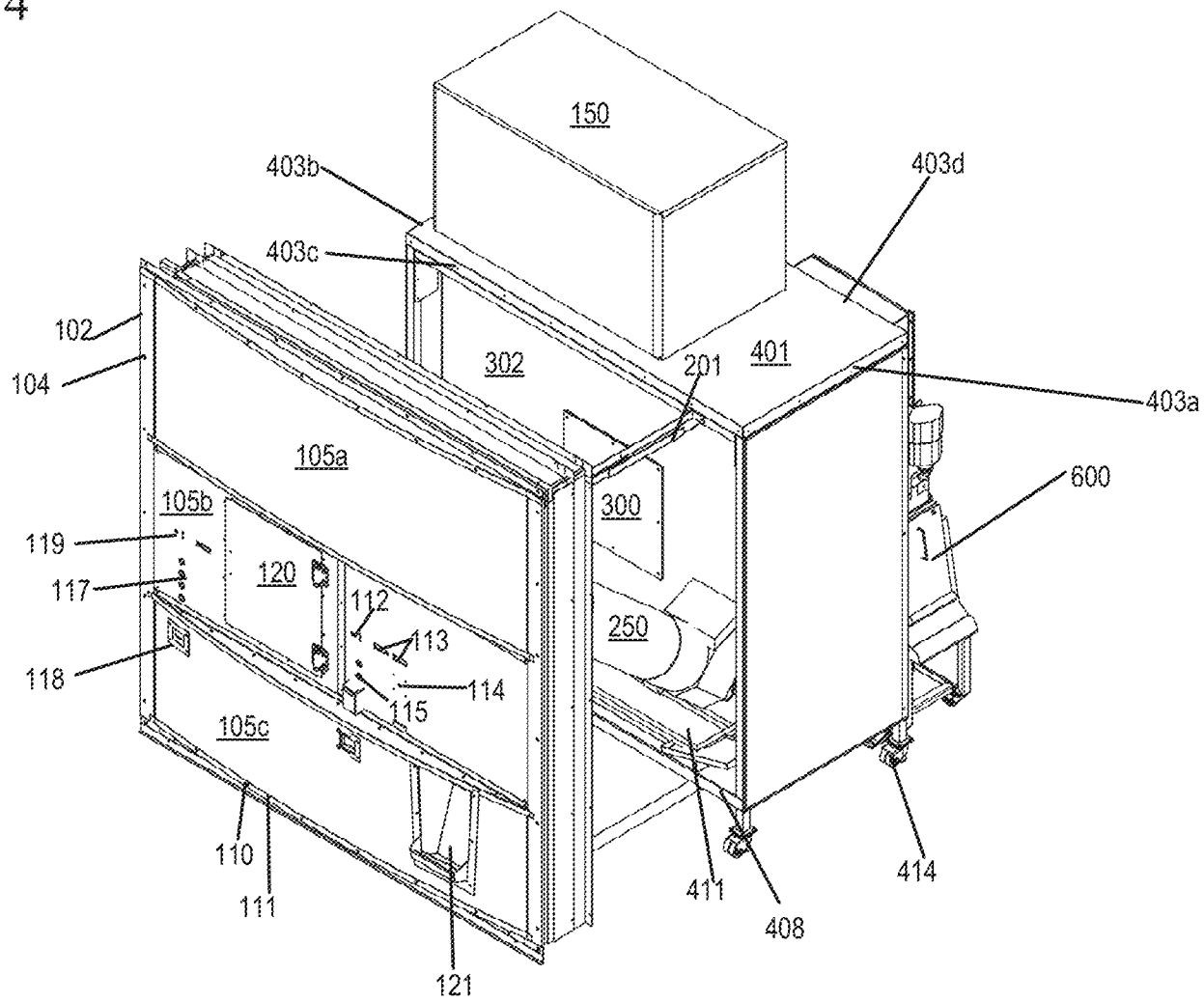
FIG. 4 shows a front perspective view of the customer interface and machinery associated with ice production.
Figure 5:
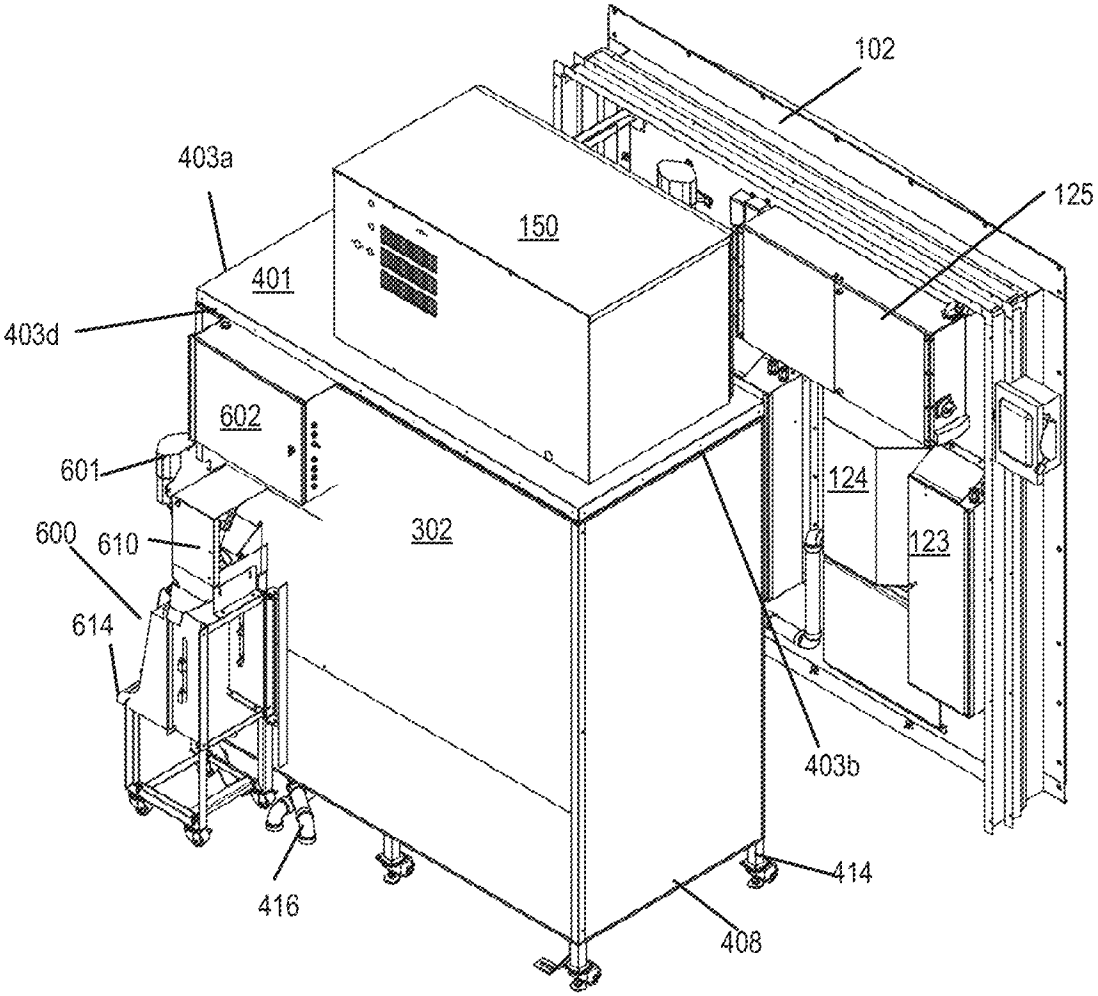
FIG. 5 shows a back perspective view of the customer interface and machinery associated with ice production for vending to the outside of the building through the customer interface and vending to the inside of the building to a bagger.
Figure 6:
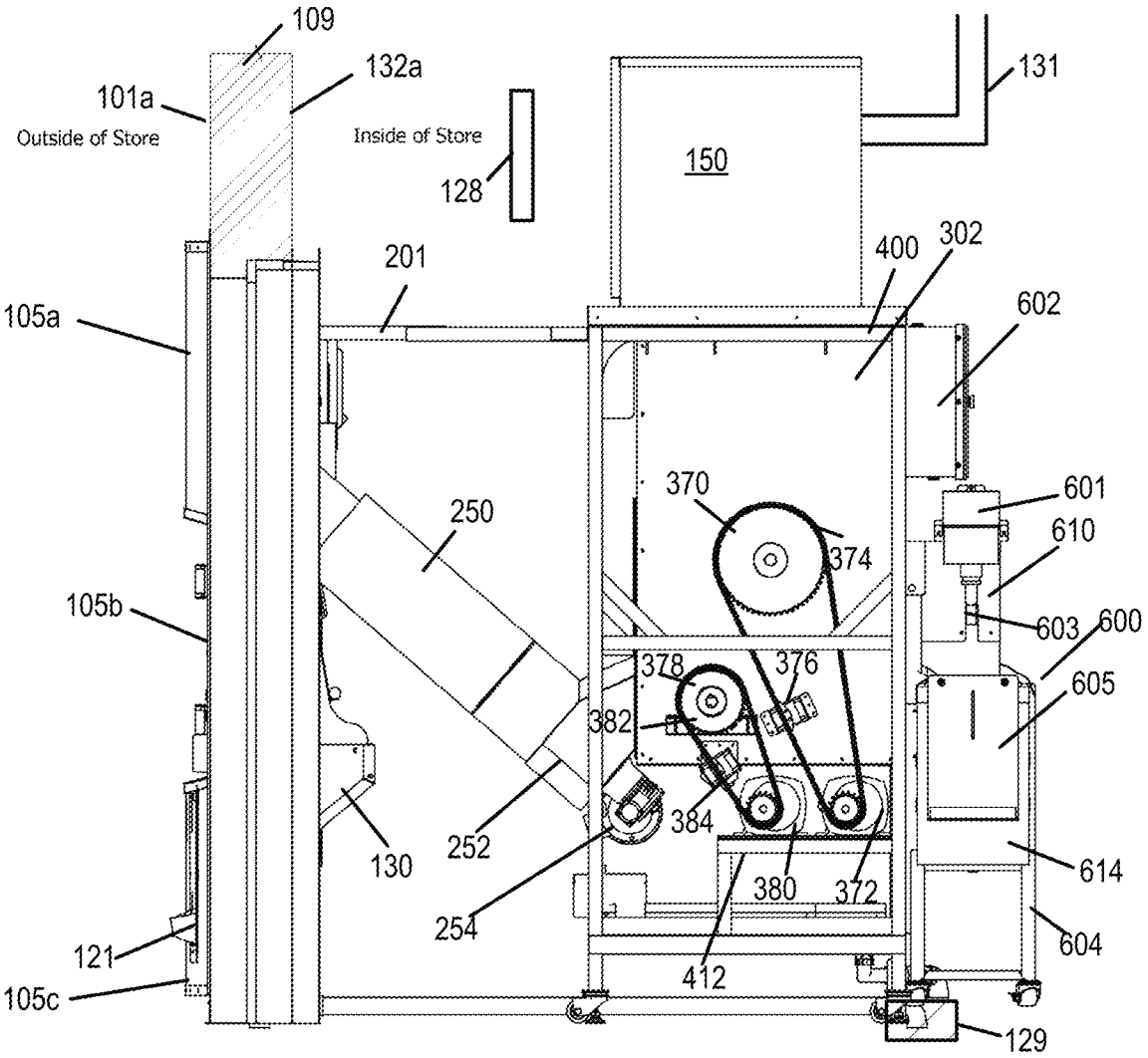
FIG. 6 shows a side view of machinery associated with ice production.
Figure 7:
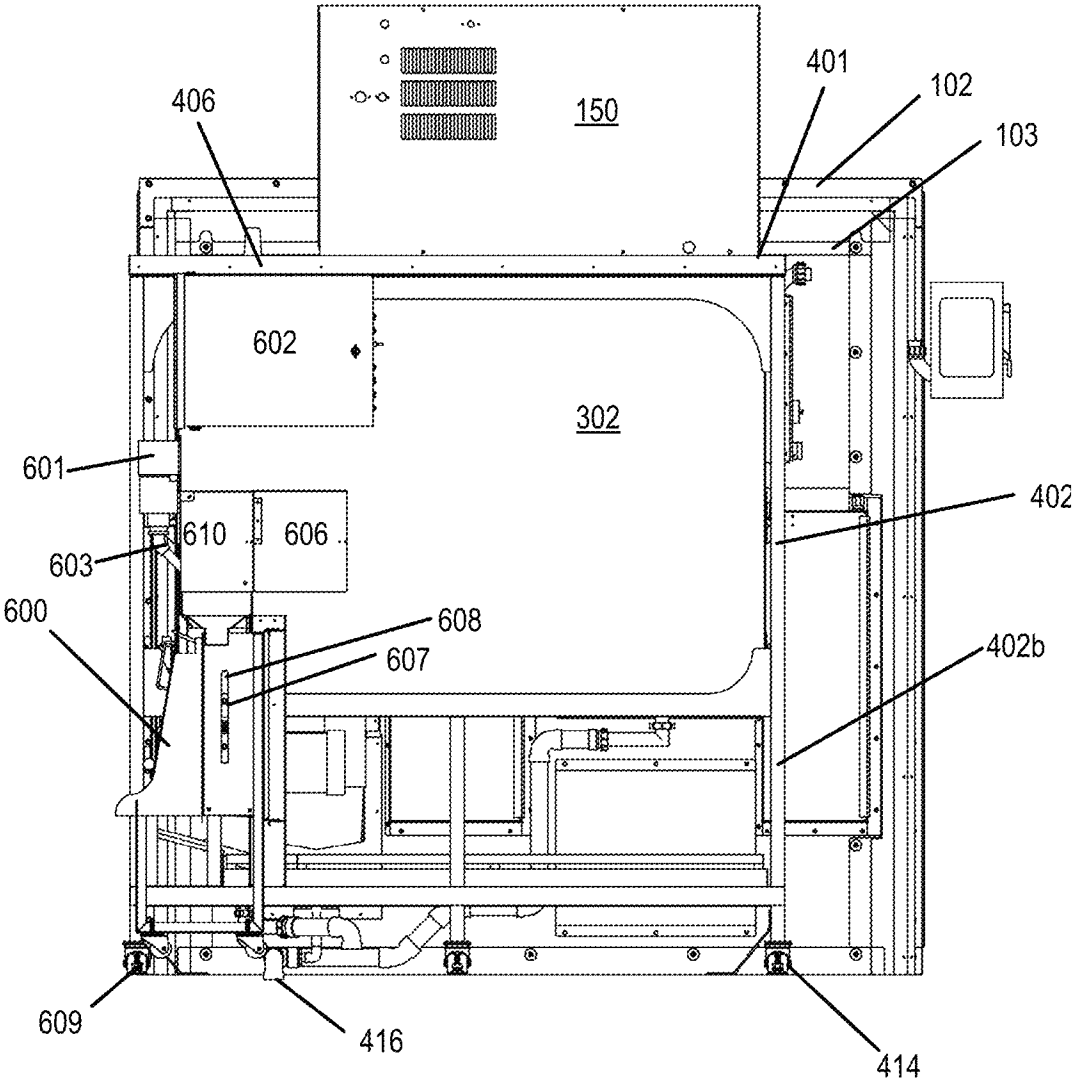
FIG. 7 shows a back view of machinery associated with ice production.
Figure 8:
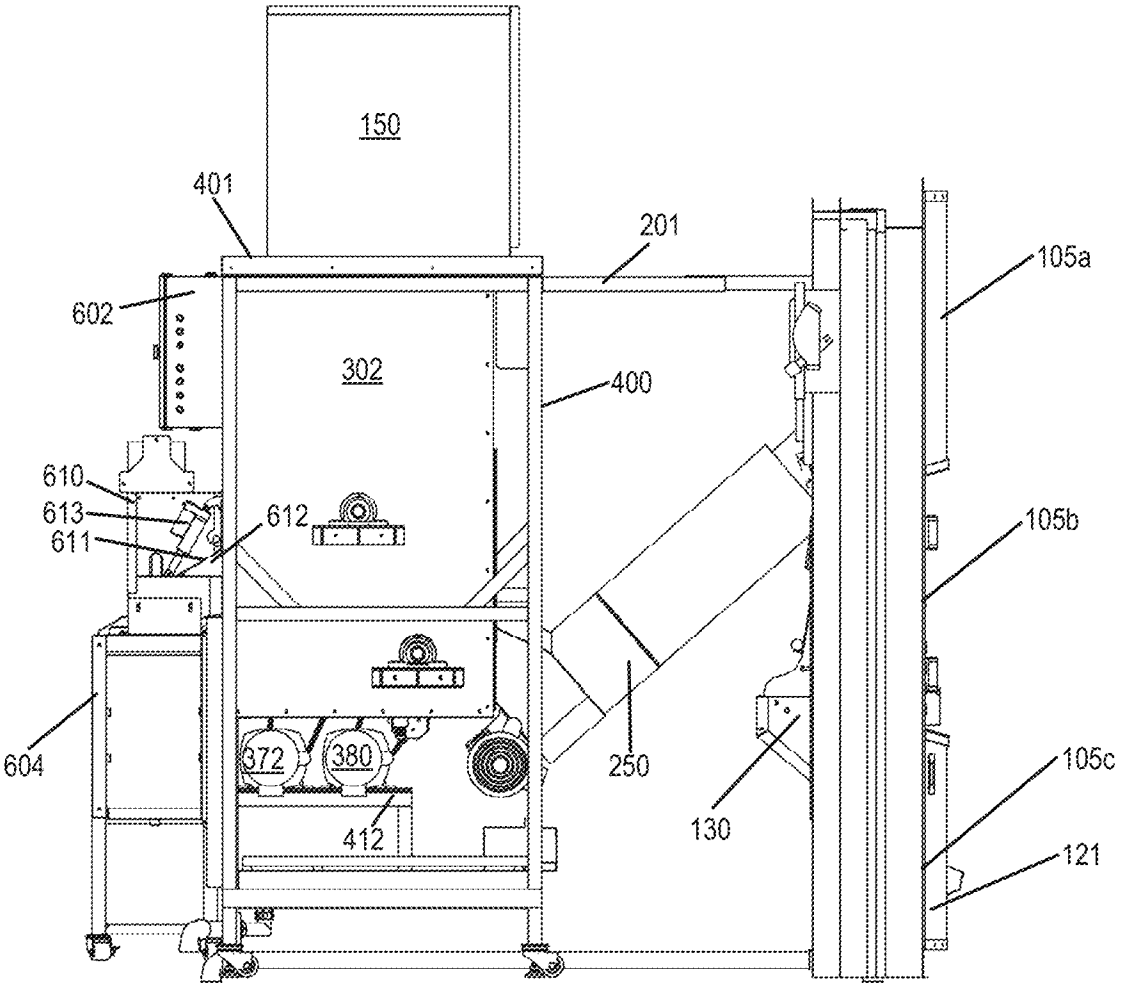
FIG. 8 shows an alternate side view of the machinery associated with ice production.
Figure 9:
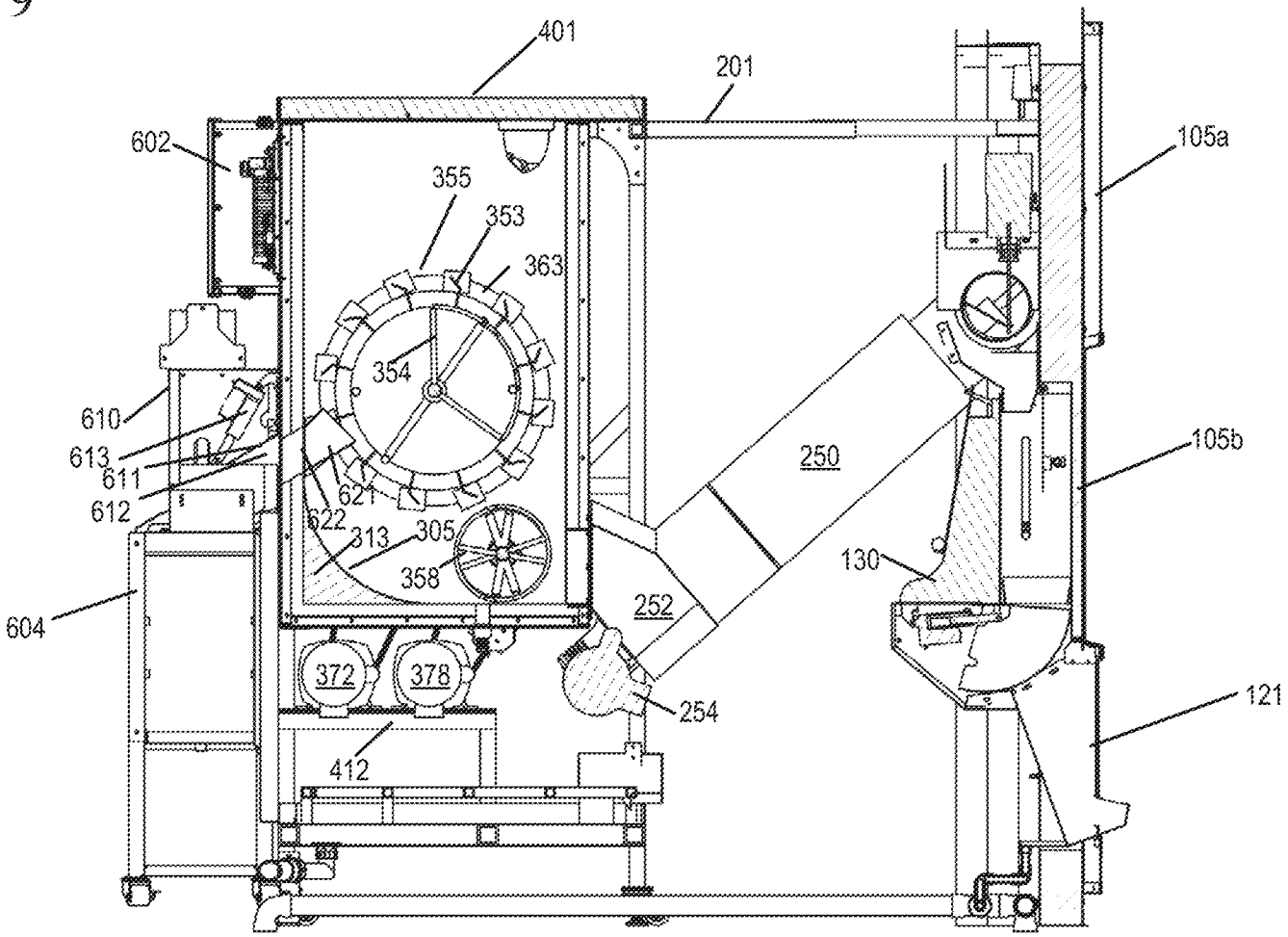
FIG. 9 a sectional view of FIG. 8.
Figure 10:
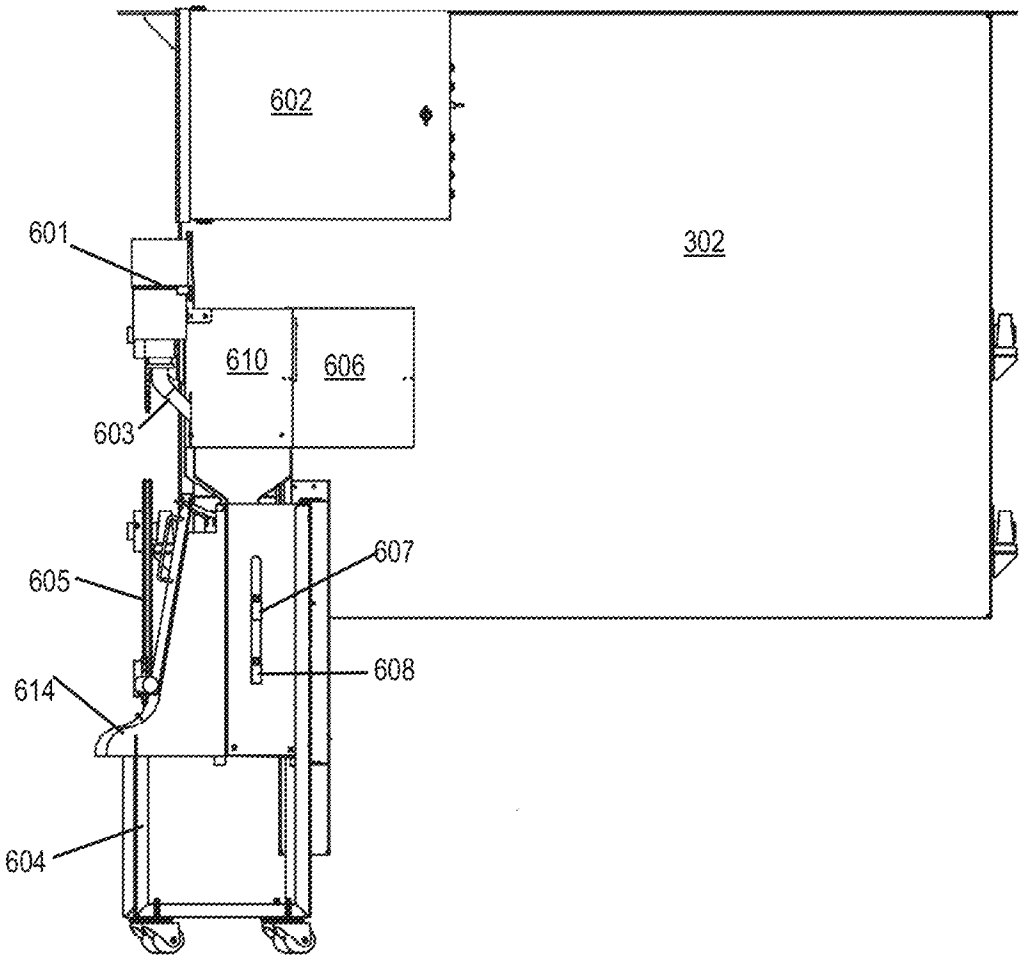
FIG. 10 shows a back view of the ice bin and associated bagger.
Figure 11:
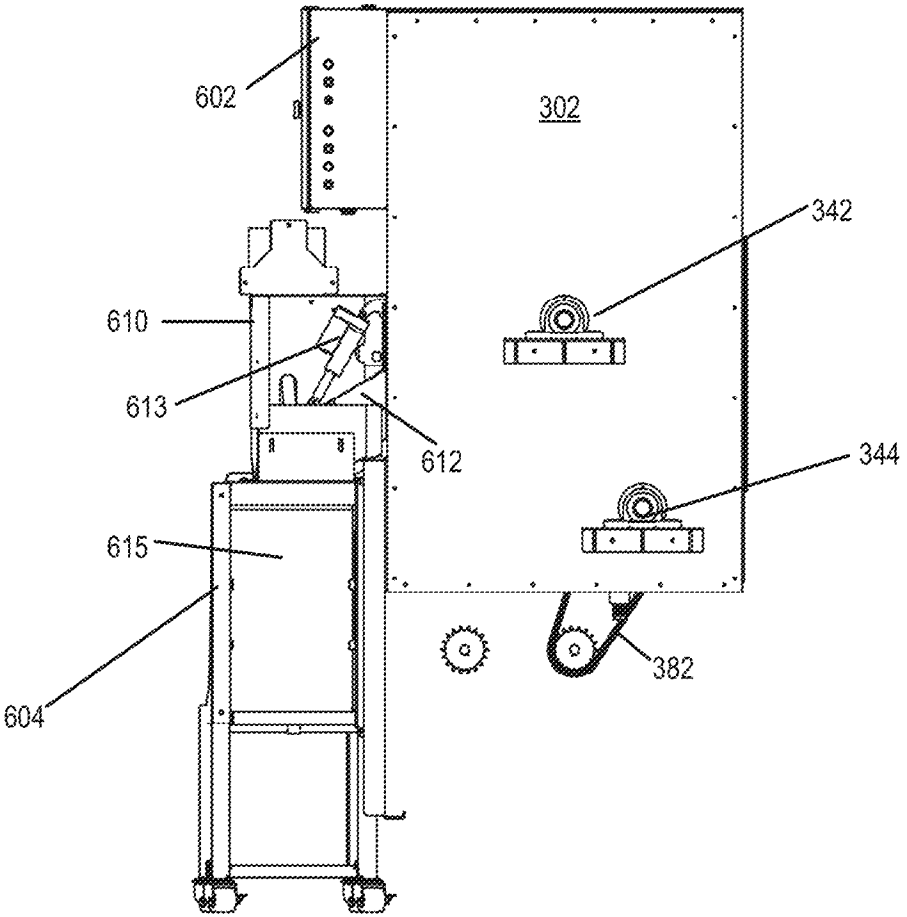
FIG. 11 shows a side view of the ice bin and associated bagger.
Figure 12:
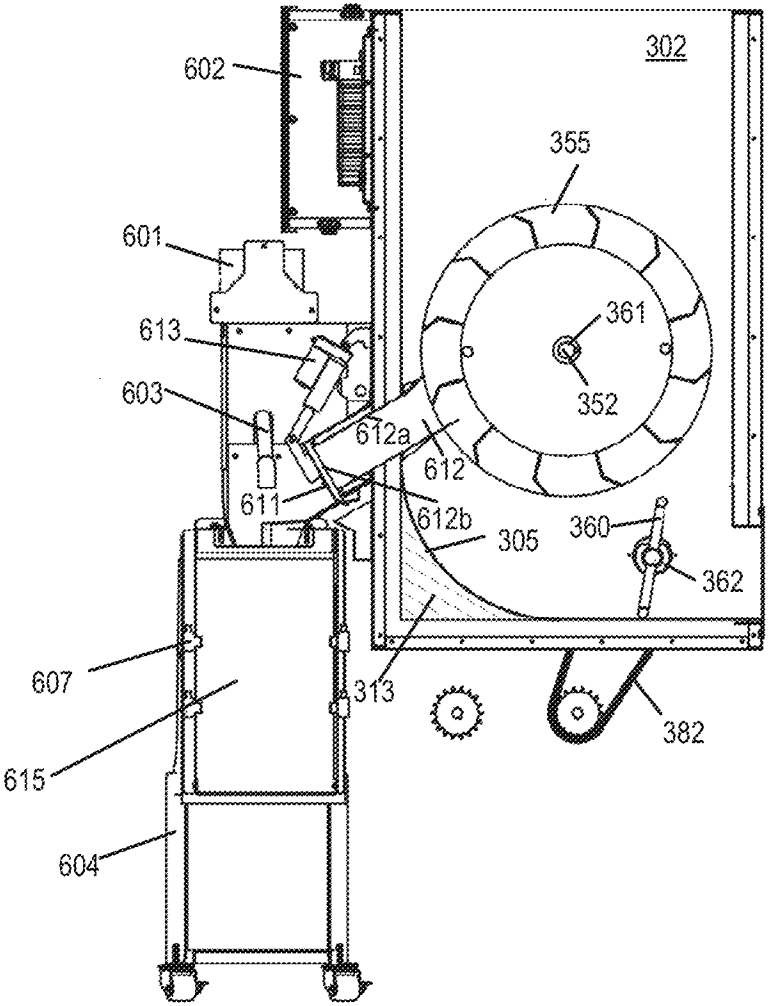
FIG. 12 shows a sectional view of the ice bin and associated bagger along line B-B of FIG. 13.
Figure 13:
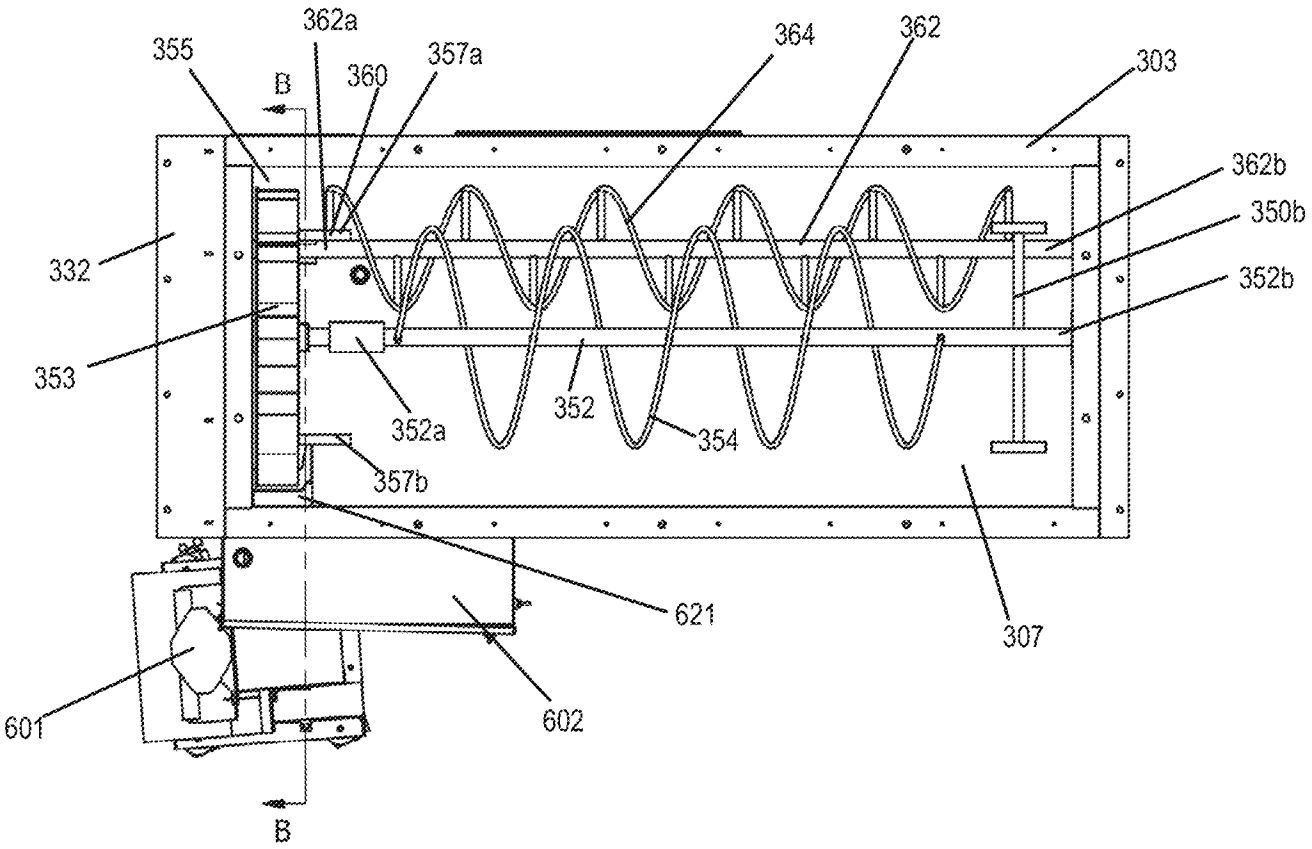
FIG. 13 shows a top down view of the ice bin and associated bagger.
Figure 14:
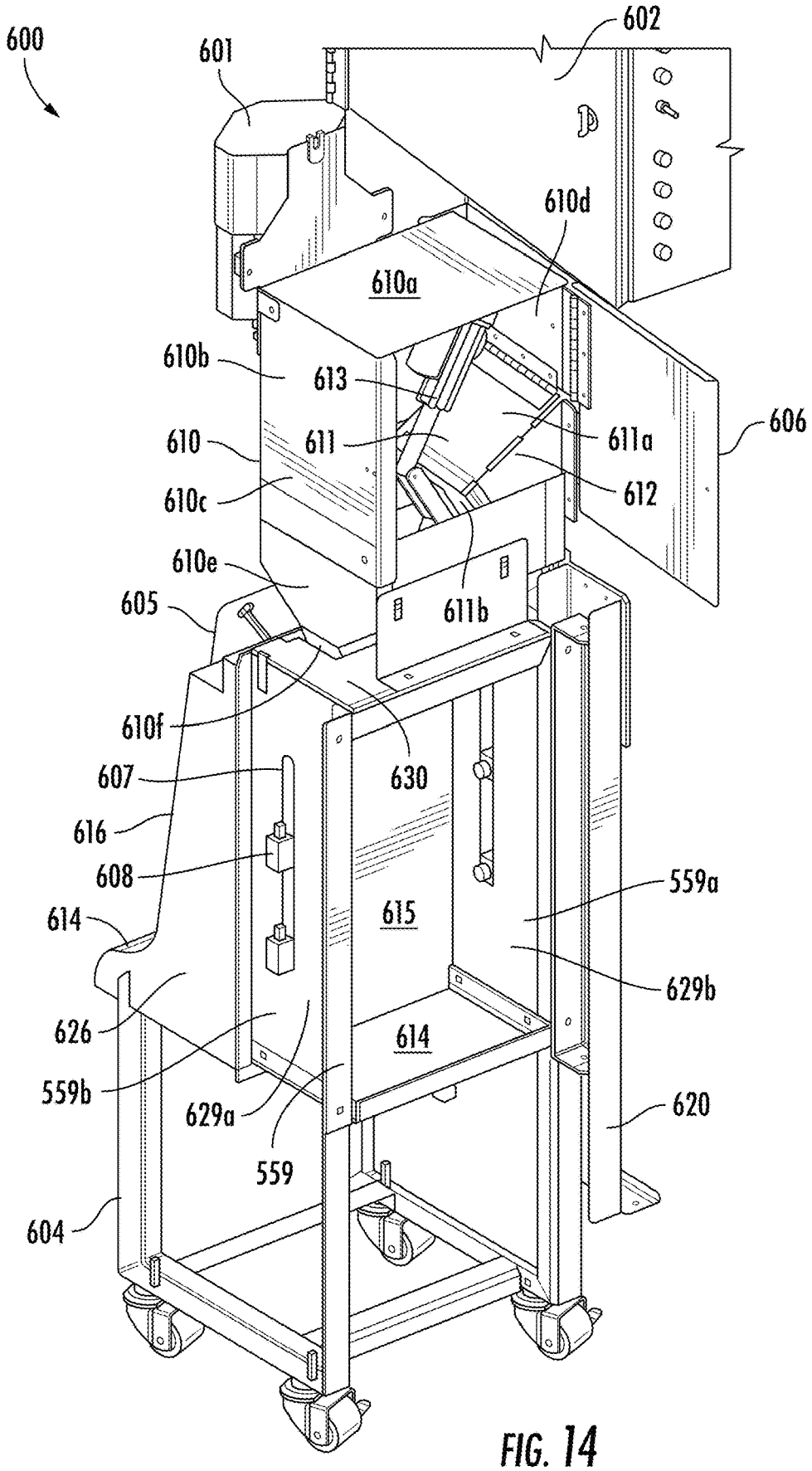
FIG. 14 shows a perspective view of the combo bagger inside the building with the spout gate closed.
Figure 15:
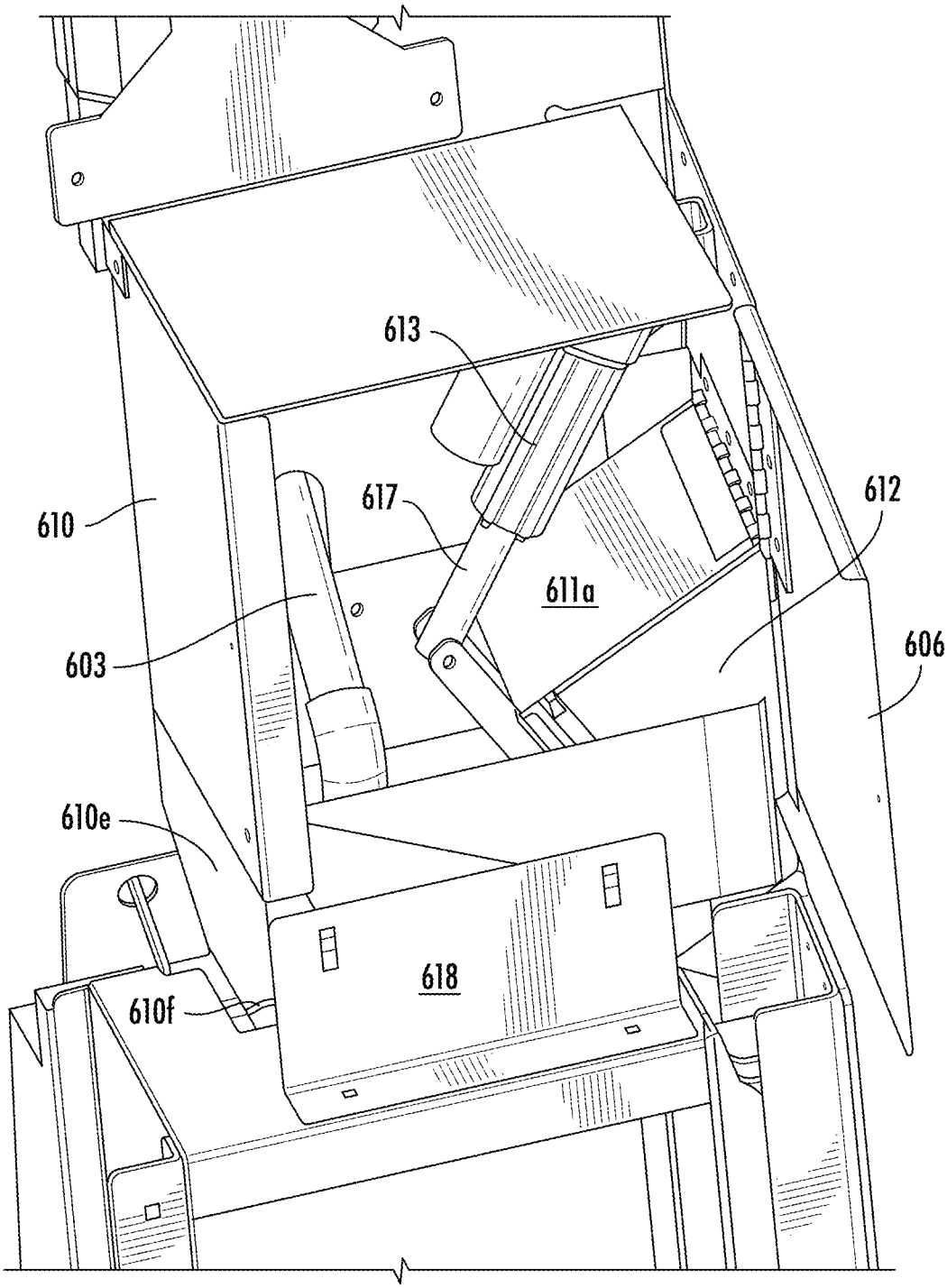
FIG. 15 shows a closeup of the spout gate in a closed position.
Figure 16:
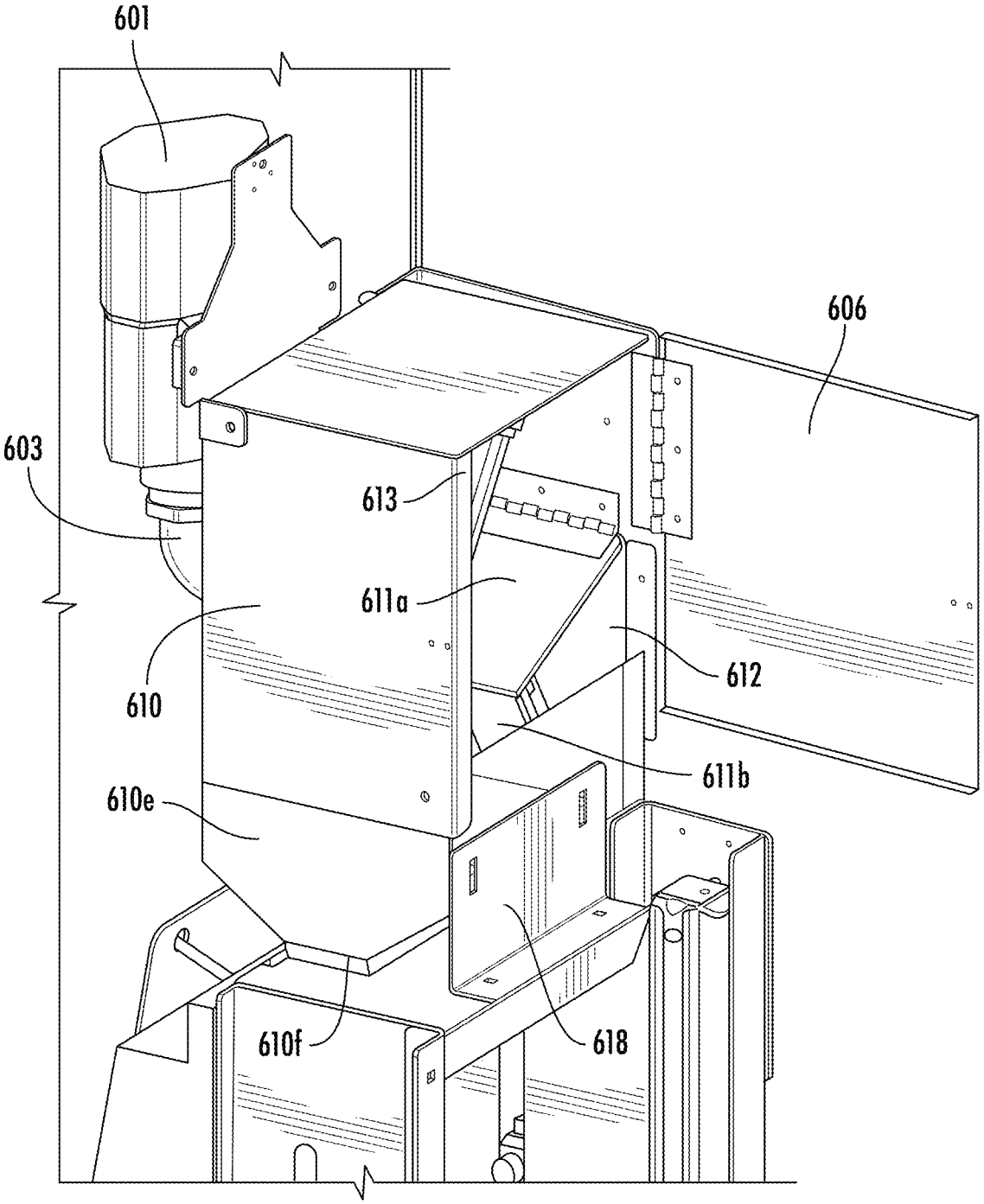
FIG. 16 shows another view of the spout gate in a closed position.
Figure 17:
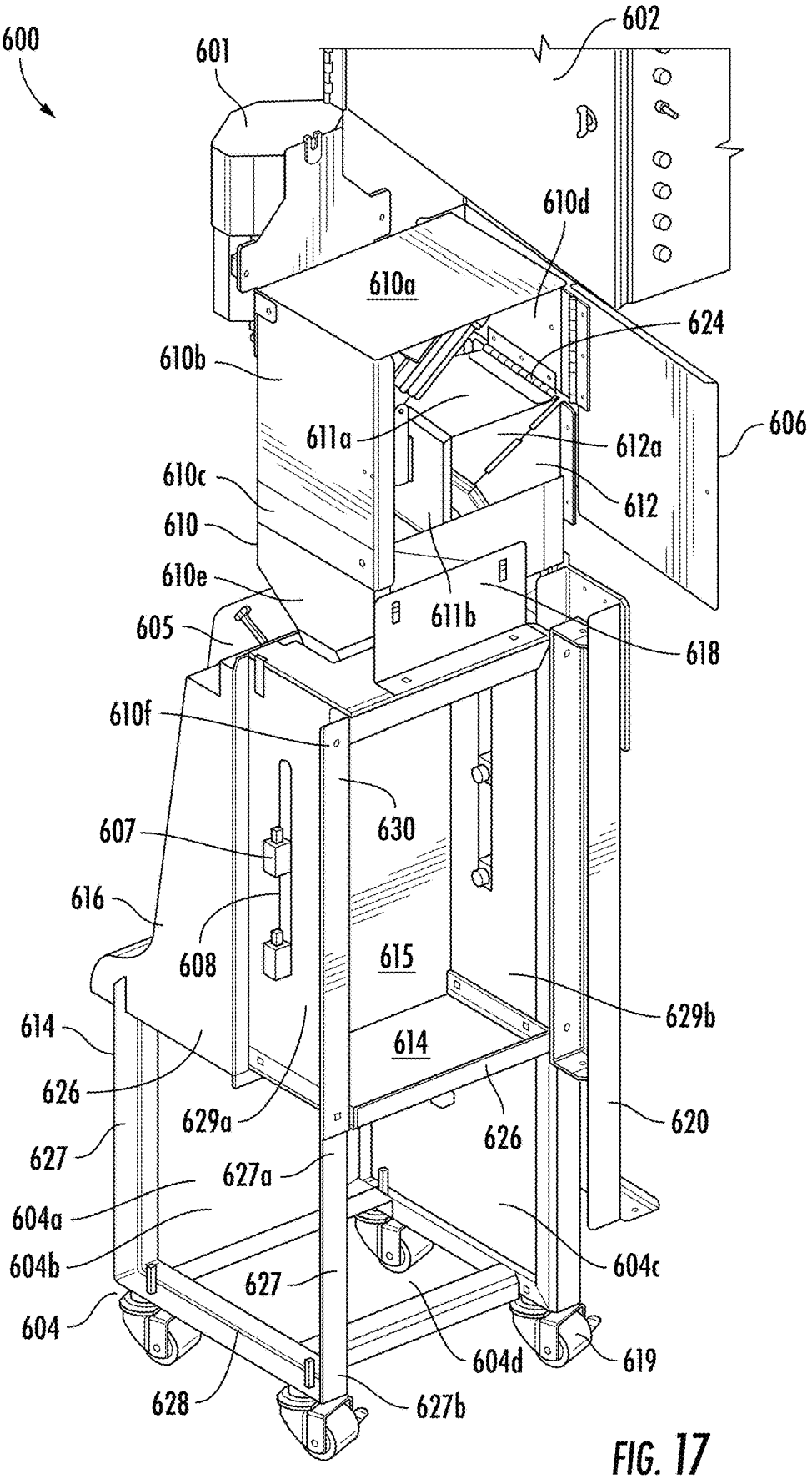
FIG. 17 shows a perspective view of the combo bagger inside the building with the spout gate open.
Figure 18:
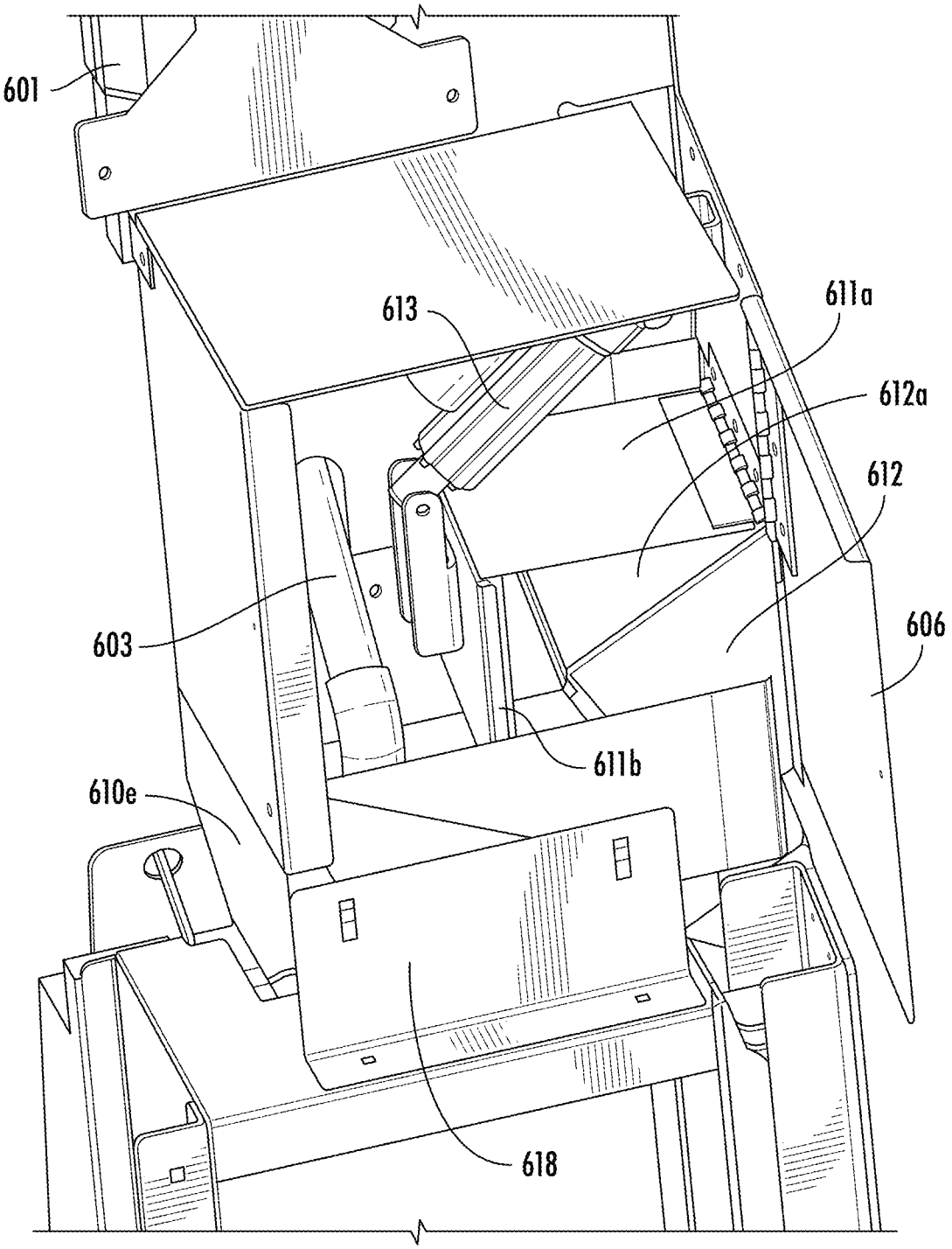
FIG. 18 shows a close up of the spout gate in an open position.
Figure 19:
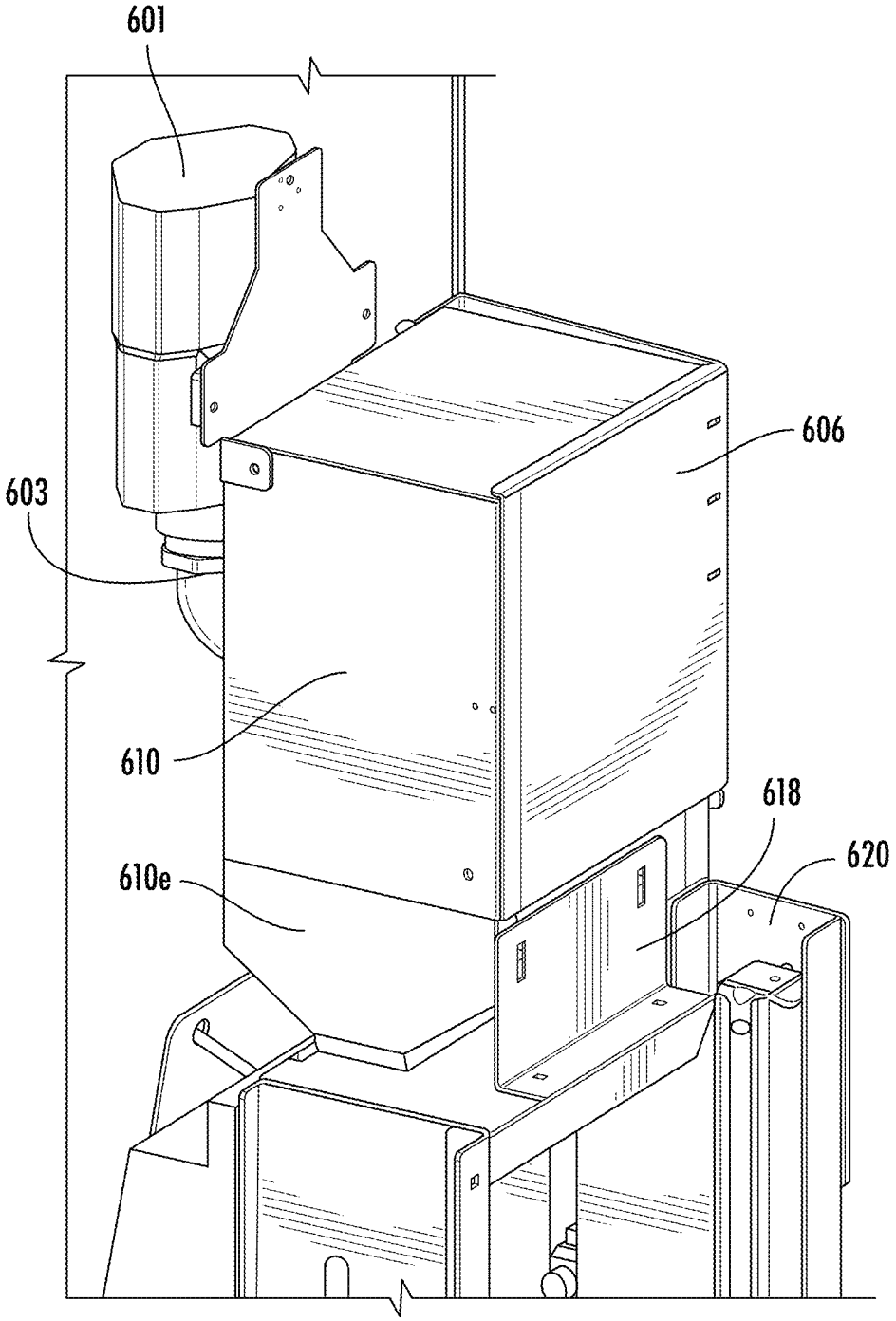
FIG. 19 shows the rear ice chute door closed during normal vending operation.
Figure 20:
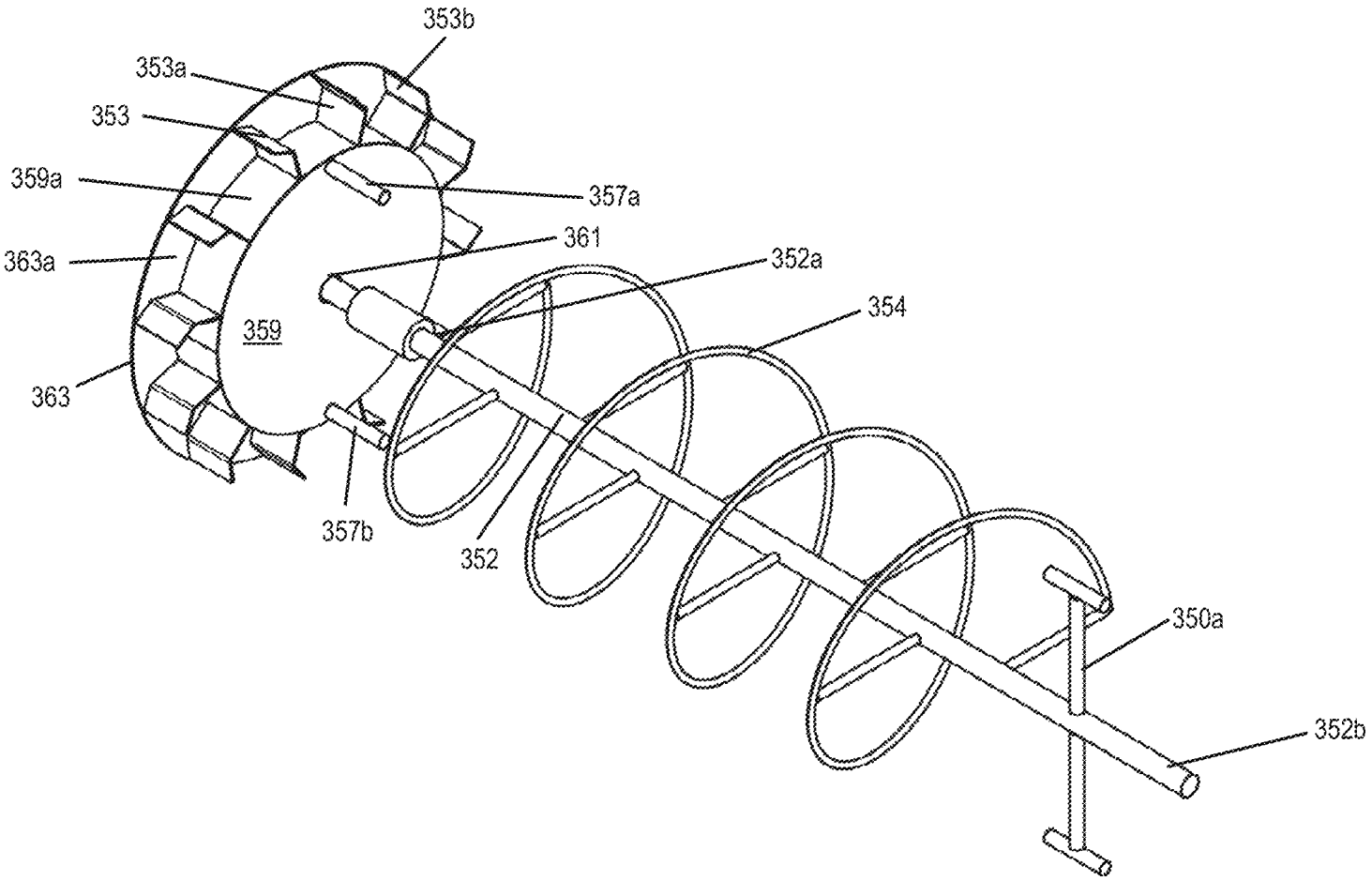
FIG. 20 shows an agitator paddle wheel connected to a horizontal auger.
Figure 21:
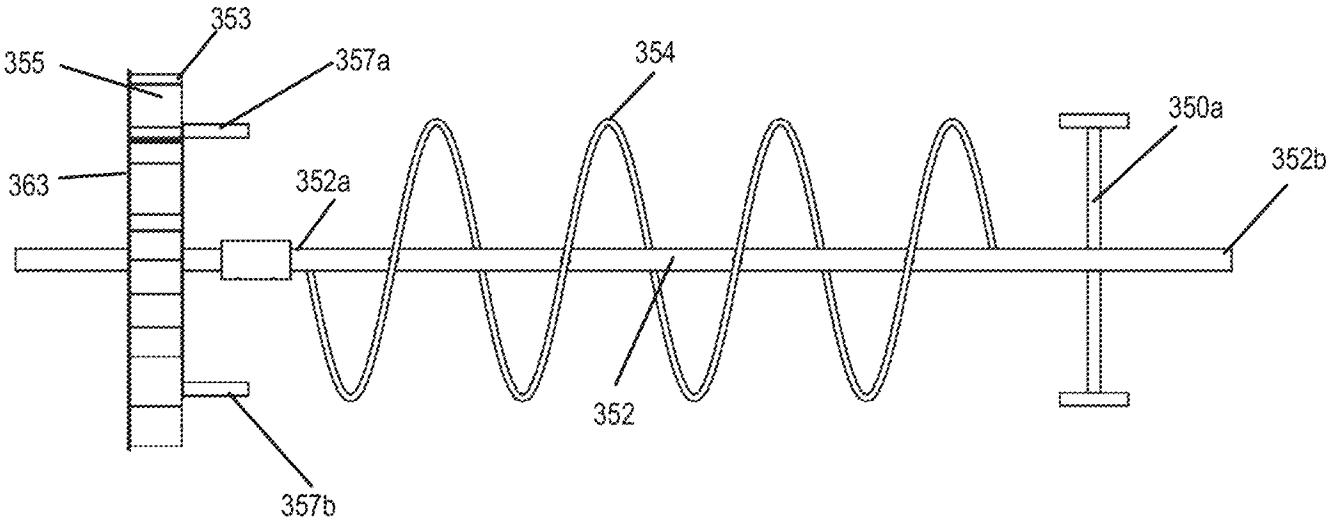
FIG. 21 shows a side view of the agitator paddle wheel connected to a horizontal auger.
Figure 22:
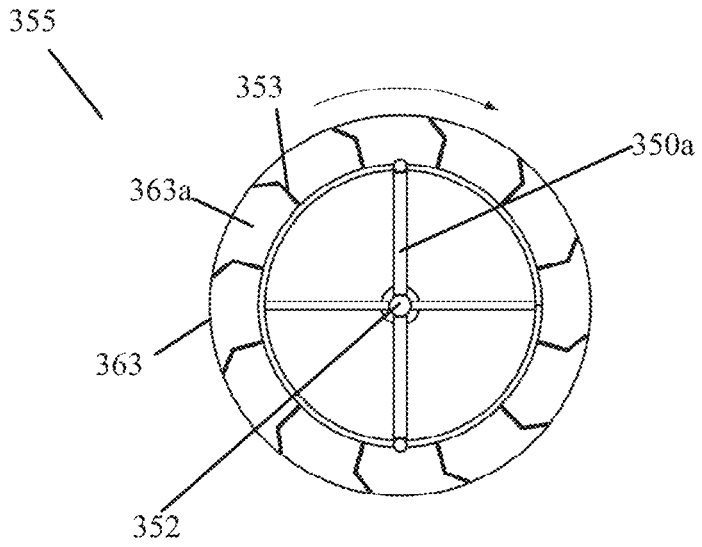
FIG. 22 shows a front view of the agitator paddle wheel.
Figure 23:
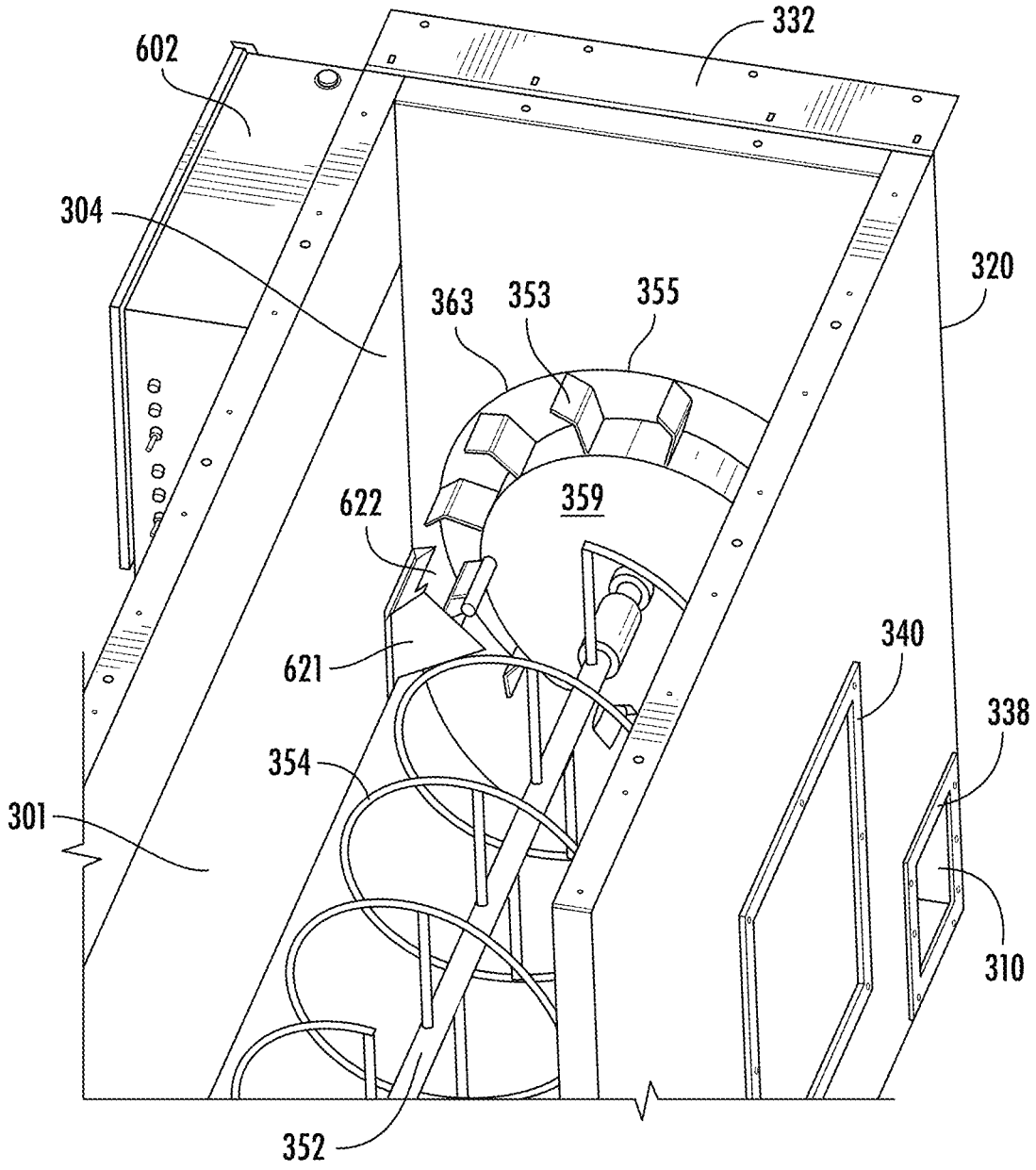
FIG. 23 shows a top perspective view of the agitator paddle wheel and horizontal auger within the ice storage bin.
Figure 30:
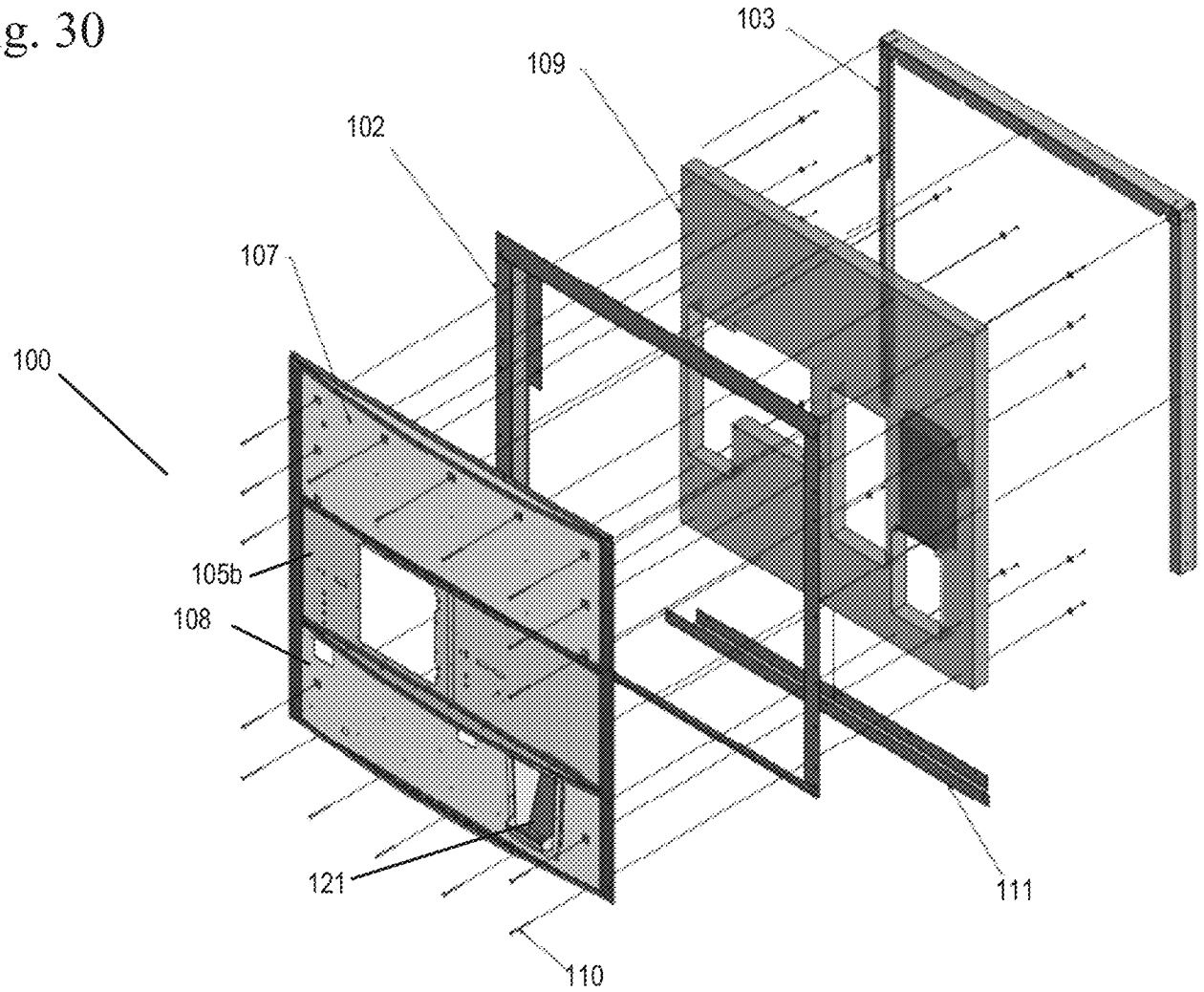
FIG. 30 shows an exploded view of the customer interface and trim relative to a wall of the building.
Figure 31A:
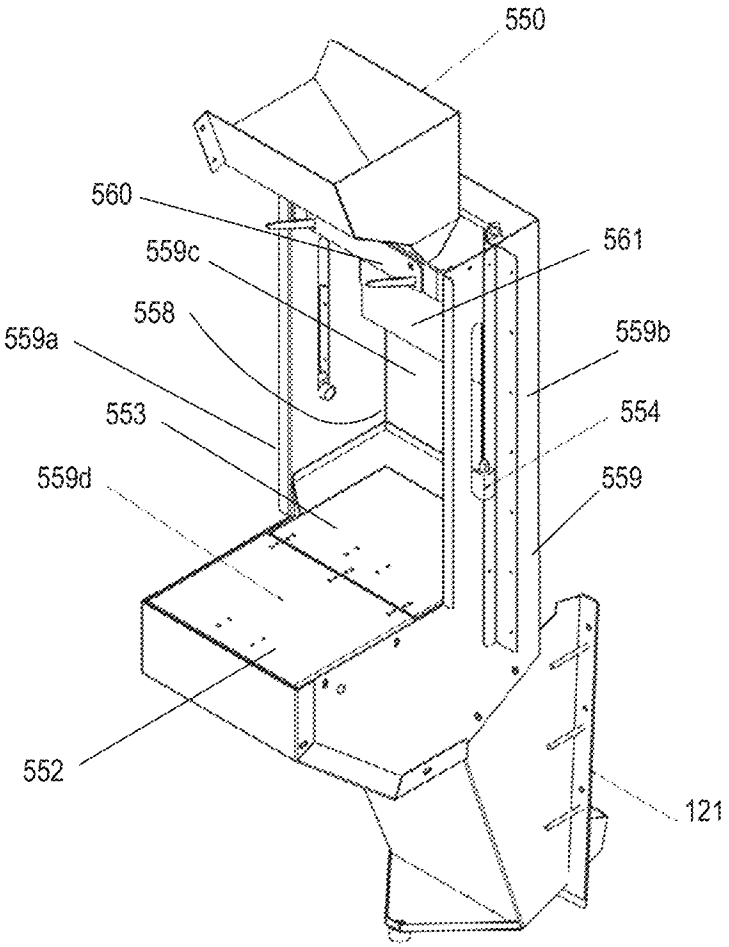
FIG. 31*a* shows a perspective view of a bagging mechanism.
Figure 31B:
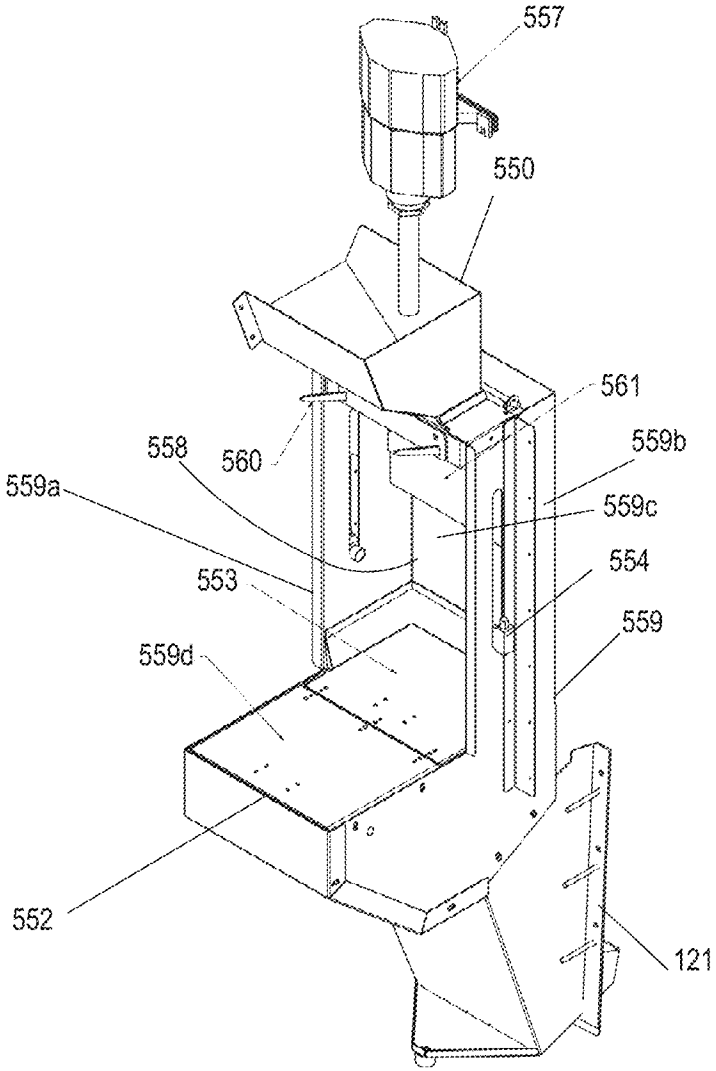
FIG. 31*b* shows another perspective view of the bagging mechanism including the blower.
Figure 32A:
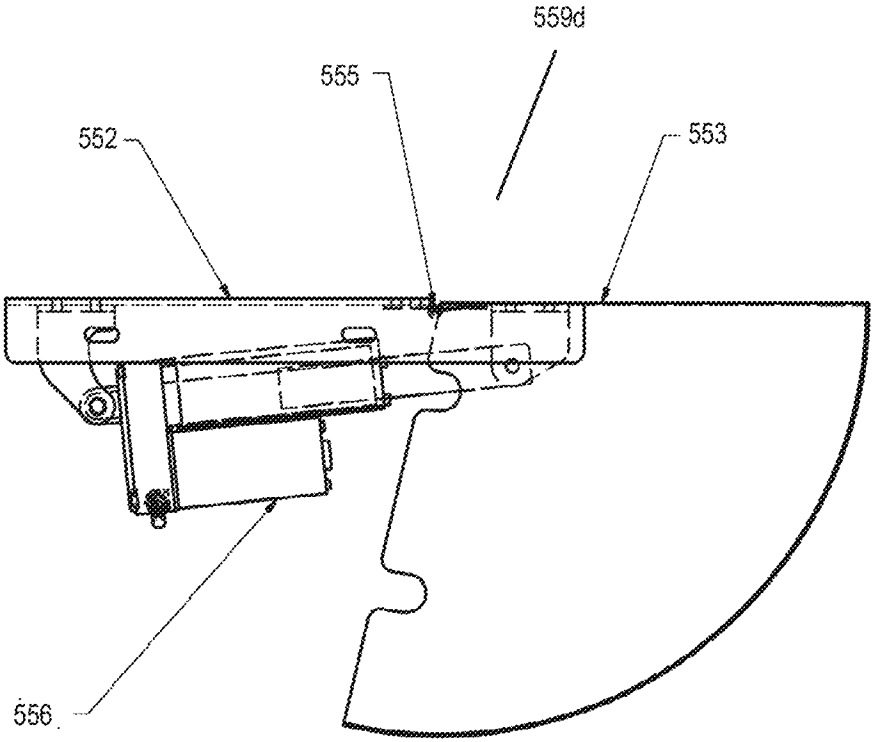
FIG. 32*a* shows a side view of the drop mechanism of the bagging mechanism.
Figure 32B:
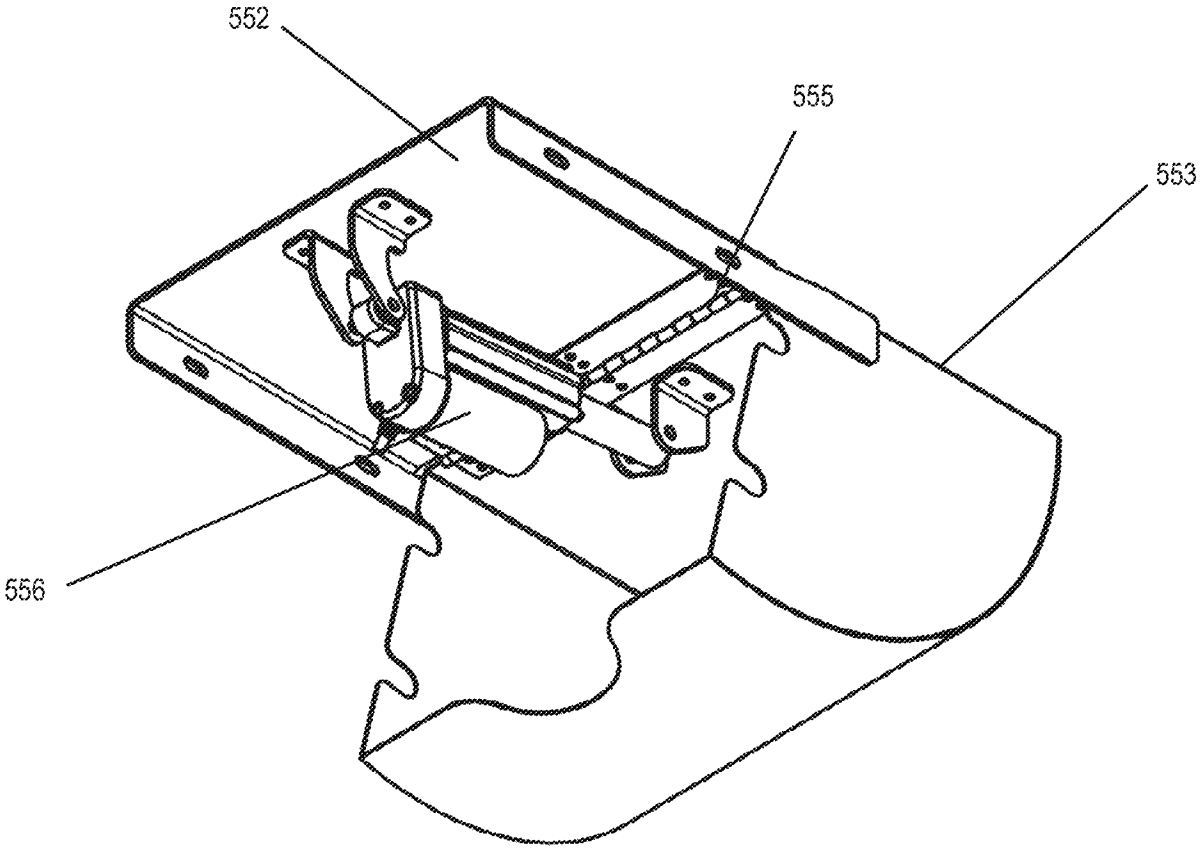
FIG. 32*b* shows a bottom perspective view of the drop mechanism of the bagging mechanism.
Figure 33:
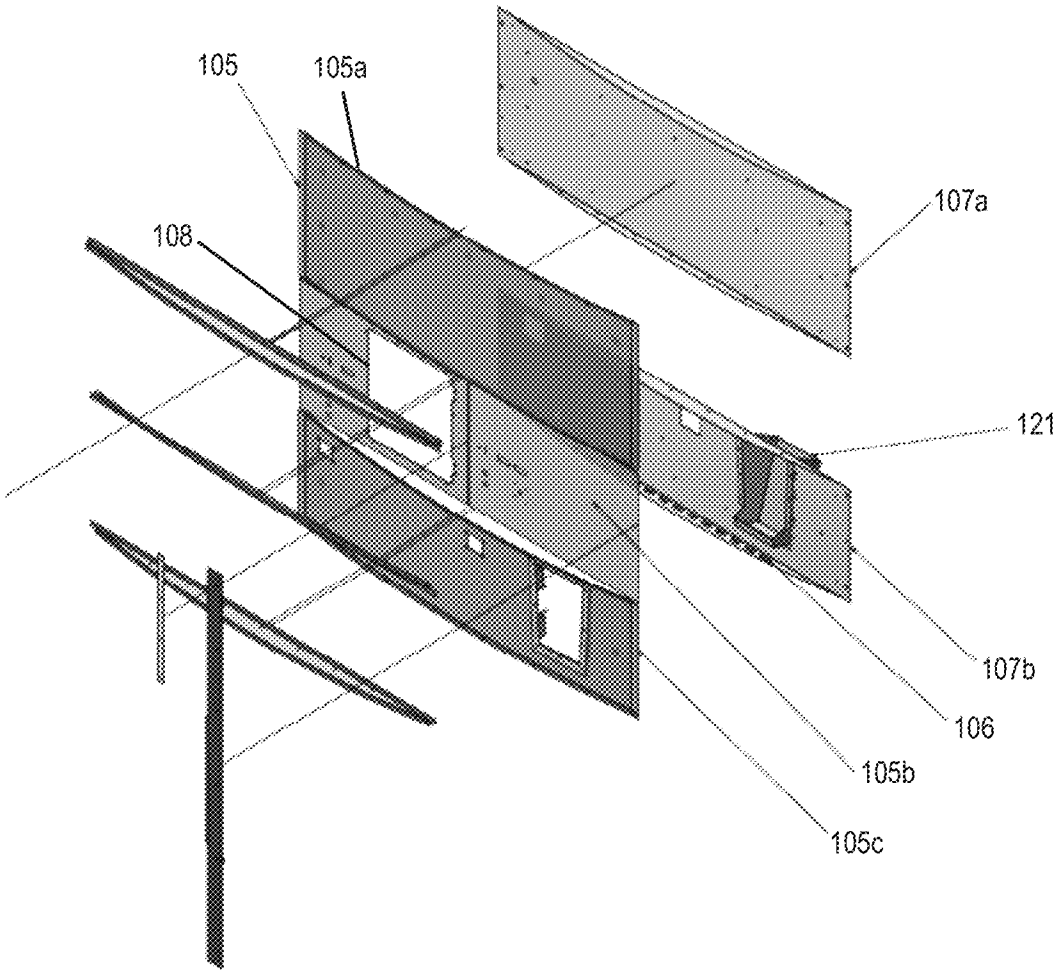
FIG. 33 shows an exploded view of the customer interface.

Referring to FIGS. 4, 30 and 33, the vendor front back panel 107 has a top vendor front back panel 107*a* and a bottom vendor front back panel 107*b* with the bag chute 121 and a plurality of LED back lights 106. A top bubble front panel 105*a* is mounted to the top vendor front back panel 107*a* and a bottom bubble front panel 105*c* is mounted to the bottom vendor front back panel 107*b*. Between the top and bottom bubble front panels 105*a* and 105*c* is a flat panel 105*b* which has an opening 108 for vending water. The central flat panel 105*b* provides a customer interface for both water and ice outside of the store. The top bubble front panel 105*a* and the bottom bubble front panel 105*c* are preferably made of polycarbonate. Stainless steel outer trim and fasteners can be used to secure the top bubble front panel 105*a* and the bottom bubble front panel 105*c* to the metal top vendor front back panel 107*a* and the metal bottom vendor front back panel 107*b*.

The customer interface 100 vends water and ice as well as allowing for payment of the water and ice by the customer without the customer having to enter the store. The customer, using their own receptacle, can place the water receptacle in the opening 108 covered by the water vendor user access door 120, select options associated with the water through the selection buttons 117 and make payment in the water vending payment area 119. If the customer pays using cash for the water, and is due change, coins are returned using the coin return chute 118. Adjacent to the water vendor user access door 120 is a vending area for ice. Ice is dispensed into a bag and provided to the customer in the bag chute 121. The customer selects options associated with the ice through the selection buttons 115 and makes payment using the bill validator 113, credit card reader 114, and/or coin insert slot 112. If the customer pays cash for the ice, and is due change, coins are returned to the customer using the coin return chute 111. The coin return chute for water 118, the coin return chute for ice 116 and the bag chute 121 are preferably located in the bottom bubble front panel 105*c* and the bottom vendor front back panel 107*b*.

Figure 24:
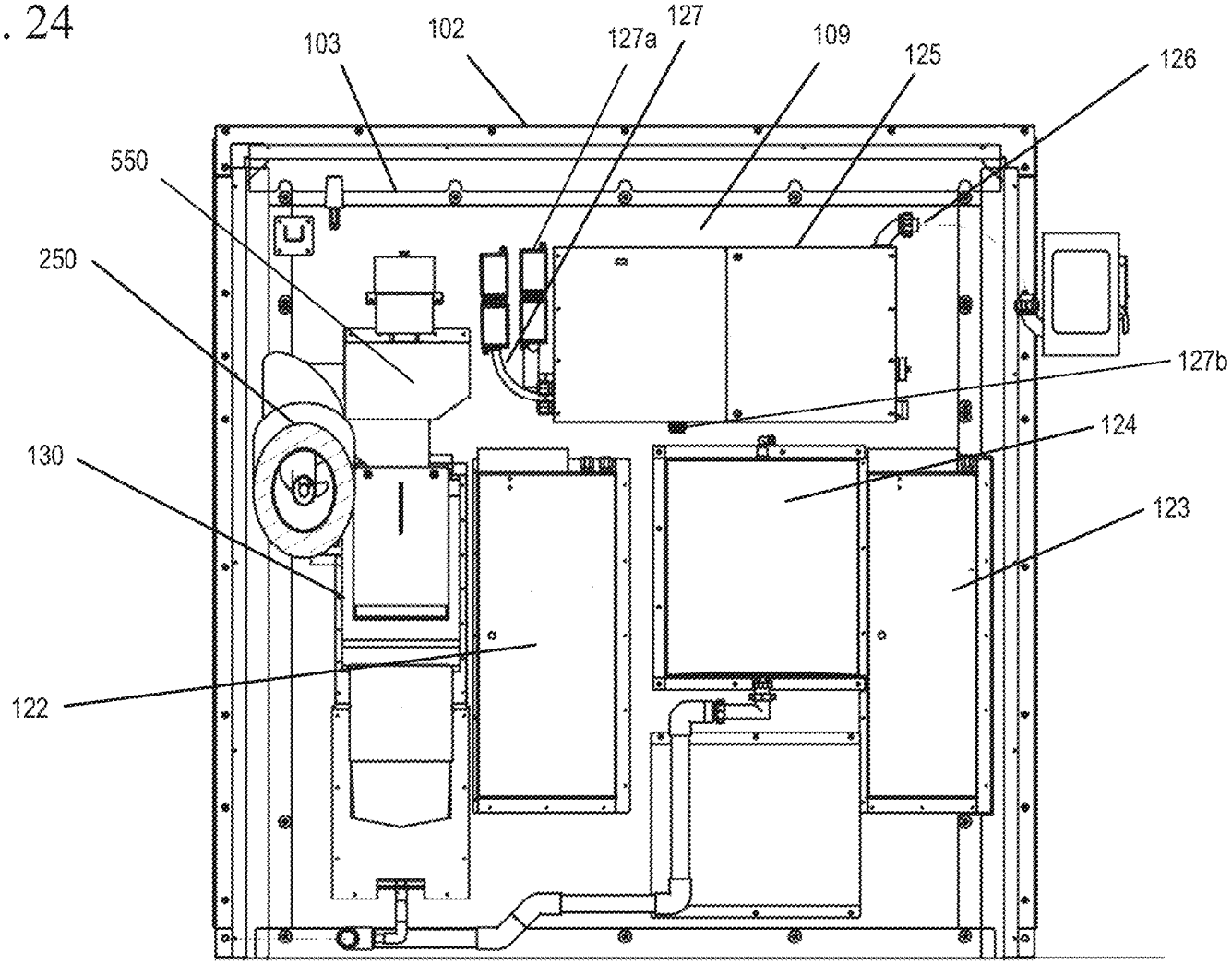
FIG. 24 shows a back view of the vending interface.
Figure 25:
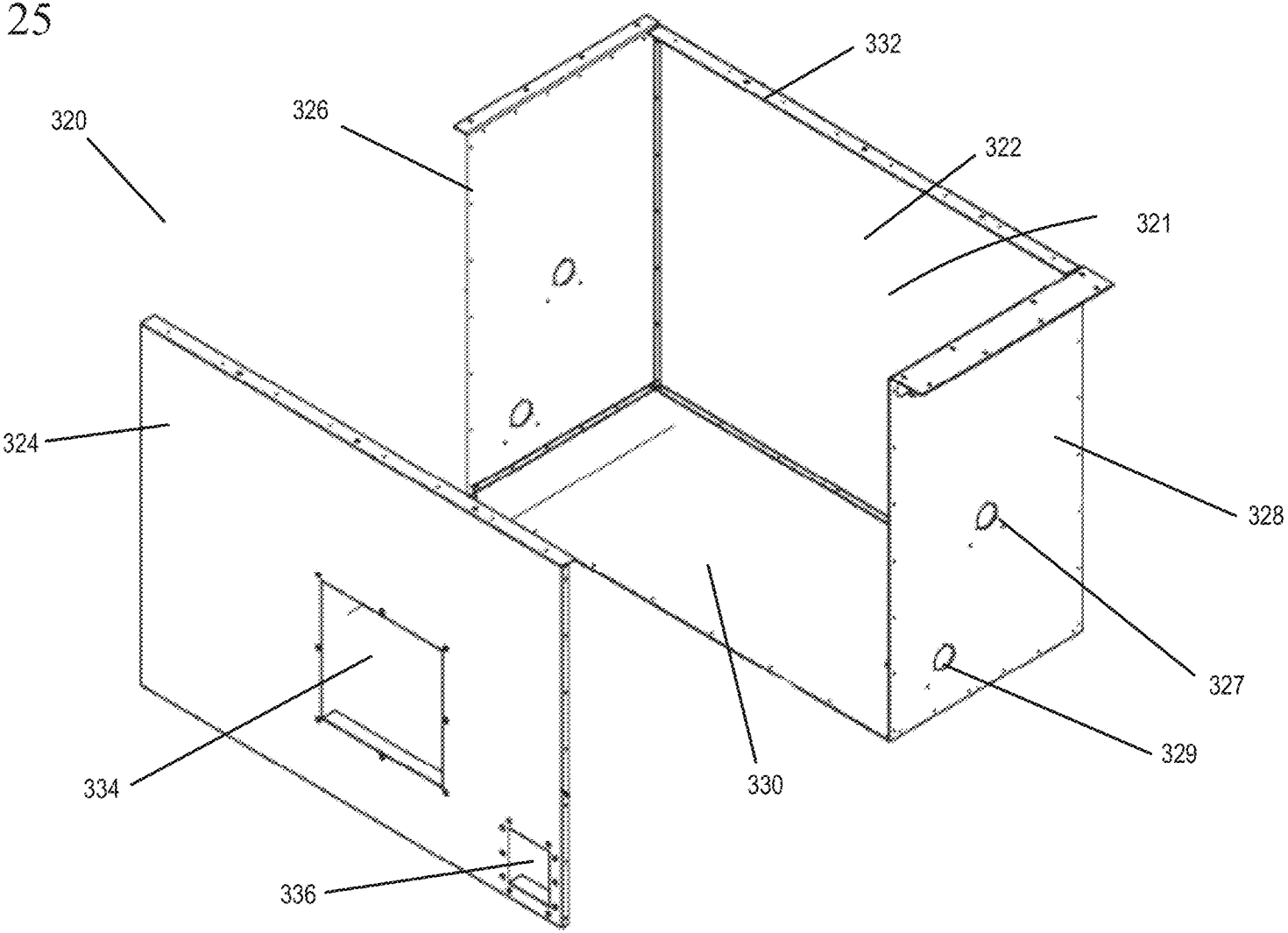
FIG. 25 shows an outer sleeve of the ice storage bin.
Figure 26:
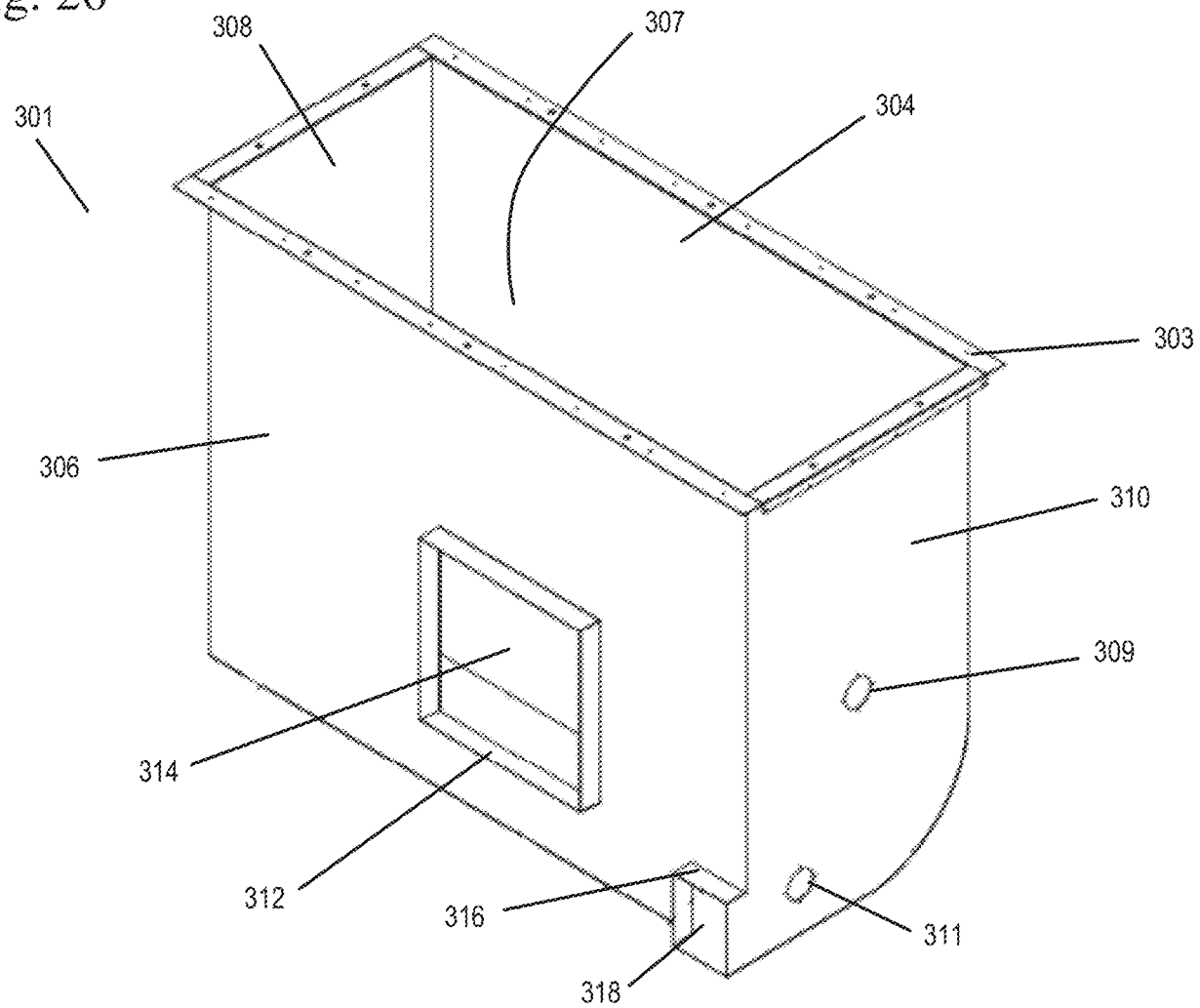
FIG. 26 shows an inner sleeve of the ice storage bin.
Figure 27:
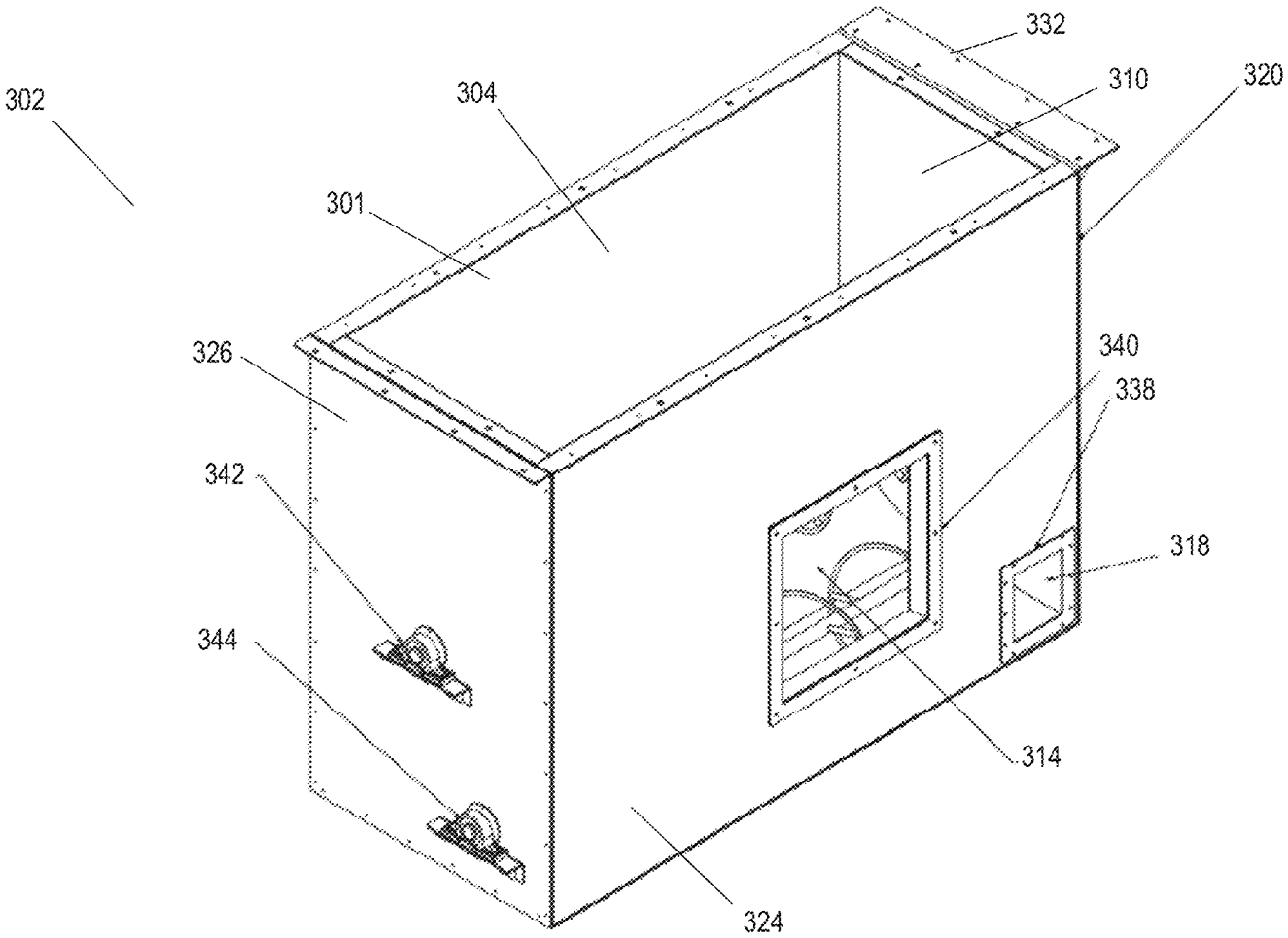
FIG. 27 shows a prospective view of the ice storage bin.

FIG. 24 shows a back view of the insulated front wall 109. An electrical control box 125 includes an electrical power IN 126 and an electrical power OUT 127 which provides power to the icemaker and all electrical motors installed on the bin and electrical power OUT 127*b* which provides power to electrical components of the customer interface, such as the LED backlights 106 and vending machinery including, but not limited to, the bagging mechanism 130, ice payment area 122 and water payment box 123 and water vendor 124.

Referring to FIGS. 2-3, 6 and 24 the ice bagging mechanism 130 is coupled to a vertical/incline auger assembly 250 and an ice hopper 550 which supplies ice generated by the ice maker 150 and present in ice bin 302. The ice bagging mechanism 130 is shown in greater detail in FIGS. 31*a*-32*b*. The ice maker 150 and ice bin 302 are stored on a rolling bin-cabinet 400 shown in FIGS. 6-9. The ice maker 150 is coupled to a refrigeration line 131 and a water in line 128. The vertical/incline auger assembly 250 spaces the rolling bin-cabinet 400 a distance from the back of the insulated front wall 109. The distance is preferably at least 32 inches. The distance allows for routine and critical service and maintenance.

Referring to FIGS. 31*a*-32*b*, the bagging mechanism 130 includes an ice hopper 550 which supplies ice to space 558 defined by an ice bagging structure 559 consisting of two side panels 559*a*, 559*b*, a back panel 559*c*, a fixed bottom panel 552 and a rotating bottom panel 553. The bagging mechanism 130 also includes a blower 557 which blows open a bag held by the bag holder 560 which drops into the space 558 where the rotating bottom panel 553 supports the bottom of the bag. Also present within the space 558 is a bag detect flap 561. A sensor (not shown) may be present behind the bag detect flap 561 which detects when the bag is present in the space 558, fully blown open, and ready to be filed with ice. The sensor (not shown) sends a signal via a controller (not shown) to start the auger motors 372, 380. Ice level sensors 554 are additionally present within the space 558 to monitor for the level of ice present within the bag. The ice level sensors 554 includes a transmitter to transmit electrical signals regarding the level of the ice or a simple on or off command with regards to providing ice to the bagging mechanism 130 for the bag to the controller controlling the auger motors 372, 380 and a receiver to receive an electronic signal regarding the ice level in the bag. As soon as the ice within the bag reaches a predetermined amount, the ice level sensors 554 transmit a signal to the auger motors 372, 380 to stop and to initiate the actuator 556 located beneath the fixed bottom panel 552 and the rotating bottom panel 553 to actuate the rotating bottom panel 553 to rotate about hinge 555, such that the filled bag of ice drops into the bag chute 121. The actuator 556 may be electrically operated or may be pneumatic.

As shown in FIGS. 4-9, the rolling bin-cabinet 400 is preferably square or rectangular and has four sides 403*a*-403*d* with each side 403*a*-403*d* defined by a cabinet roof 406, two side rails 402 each with a first end 402*a* and a second end 402*b*, and a bottom rail 408. A center side rail 410 is also present parallel to and between the cabinet roof 406 and the bottom rail 408. Another center side rail 413 may connect to both the cabinet roof 406 and the bottom rail 408. Spanning the four sides 403*a*-403*d* of the cabinet roof 406 is a top surface 401. Each of the four sides 403*a*-403*d* additionally has casters 414 connected to the bottom rail 408. Spanning the four sides 403*a*-403*d* of the bottom rail 408 is a drain pan 411. A shelf 412 can additionally be present, connected to the drain pan 411 and at least one of the side rails 402 adjacent the second end 402*b* of the side rail 402. Additional support rails can be present on the on the rolling bin-cabinet 400 to aid supporting the ice maker 150 and the ice storage bin 302. A drain line 416 can also be attached to the drain pan 411 of the rolling bin-cabinet 400.

By using a moveable rolling bin-cabinet 400 to store the ice vending machinery, access for cleaning and maintenance of the ice maker 150 and the ice storage bin 302 and the vertical/incline auger assembly 250 is increased. Furthermore, flexible refrigerant lines and plumbing lines are also used to allow some movement of the moveable rolling bin-cabinet 400 relative to the insulated front wall 109 without having to disconnect the machinery from the insulated front wall 109.

Channel brackets 201 provide support to electrical connections between the ice vending machinery and the insulated front wall 109 as well as act as guide or connection point between ice storage bin 302 and the insulated front wall 109, to position the ice storage bin 302 in the correct place (e.g. relative to the water line in 128, refrigeration lines 131 and drain 129) and also to provide desired vend performance.

The ice maker 150 is present on the top surface 401 of the rolling bin-cabinet 400. The ice storage bin 302 is present within the four sides 403*a*-403*d* of the rolling bin-cabinet 400. Motors 372, 380 associated with an agitator auger 356 and paddlewheel 355, and a horizontal auger 358 are preferably supported by the shelf 412. The ice maker 150 generates ice which is deposited into the ice storage bin 302.

Referring to FIGS. 4-13, 23 and 25-27, the ice storage bin 302 has an outer sleeve 320 which receives an inner sleeve 301. The inner sleeve 301 has a front plate 306 defining an access opening 314 with an access opening flange 312 and an incline auger opening 318 with an incline auger opening flange 316. The front plate 306 is connected to a left plate 308, a right plate 310 and a rear plate 304. The rear plate 304 has a rear ice storage bin opening 622 which includes a rear ice storage bin guide 621 for guiding ice through the opening 622 to a staff combo bagging structure 600. The outer sleeve 320 has a corresponding hole (not shown) for receiving the rear ice storage bin guide 621 and aligned with opening 622. It is noted that the rear ice storage bin guide 621 passes through both the inner sleeve 301 and the outer sleeve 320 of the ice storage bin.

The rear plate 304 additionally forms a bottom 305 which is connected to the left plate 308, the right plate 310 and the front plate 306. The bottom 305 is preferably curved. The right plate 310, the left plate 308, the front plate 306 and the rear plate 304 all define an inner sleeve opening 307. The upper edges of the rear plate 304, the front plate 306, the left plate 308 and the right plate 310 all have outer trim 303. The left plate 308 and the right plate 310 each have a first opening 309 and a second opening 311 to receive shaft ends of an agitator shaft 352 and a horizontal auger shaft 362. The inner sleeve 301 preferably made of stainless steel. The access opening flange 312 and the incline auger opening flange 316 are also preferably made of stainless steel.

The outer sleeve 320 has a front plate 324 defining an access opening 334 which is aligned with the access opening 314 of the inner sleeve 301 and an auger opening 336 which is aligned with the incline auger opening 318 of the inner sleeve 301. The outer sleeve 320 is preferably made of aluminum except for the front plate 324 which is preferably made of stainless steel.

The front plate 324 is connected to a left plate 326, a right plate 328 a rear plate 322 and a bottom plate 330. The right plate 328, the left plate 326, the front plate 324, the bottom plate 330, and the rear plate 322 all define an outer sleeve opening 321. The upper edges of the rear plate 322, the front plate 324, the left plate 326 and the right plate 328 all have outer trim 332 in which outer trim 303 of the inner sleeve 301 rests. The left plate 326 and the right plate 328 each have a first opening 327 and a second opening 329 to receive shaft ends of an agitator shaft 352 and a horizontal auger shaft 362 and which are aligned with the first opening 309 and the second opening 311 of the left and right plates 308, 310 of the inner sleeve 301. Insulation 313 may be present between the inner and outer sleeve 301, 320 between the rear plate 322 and the bottom plate 330 of the outer sleeve 320 and the rear plate 304 and the curved bottom 305 of the rear plate 304 of the inner sleeve 301. The insulation reduces heat transfer between the inner and outer sleeves 301, 320. Based on the design of the ice storage bin 302, it is recognized that ice only comes into contact with stainless steel.

Referring to FIGS. 12-13, and 20-23, within the inner sleeve opening 307 of ice storage bin 302 is an agitator auger shaft 352 and a horizontal auger shaft 362. The agitator auger shaft 352 has a first end 352*a* which is received within a bore 361 of a paddle wheel hub 359. Inside the bore 361 is a shaft bushing (not shown). The paddle wheel hub 359 has an outer circumference 359*a* with a plurality of paddles 353. The paddles 353 each have a first planar surface 353*a* connected to the outer circumference 359*a* of the paddle wheel hub 359 and a second planar surface 353*b* connected to the first planar surface 353*a* at an angle. The paddle wheel hub 359 is also mounted to a paddle wheel outer body 363 which provides a planar surface 363*a* perpendicular to the paddles 353. The paddle wheel outer body 363 has a greater diameter than the diameter of the paddle wheel hub 359. The paddles 353 in conjunction with the paddle wheel outer body 363 create a scoop capable of pushing or receiving ice and subsequently transporting ice to a rear ice storage bin opening 622 surrounded by the rear ice storage bin guide 621. Extending axially from the paddle wheel hub 359 are a first and a second dowel 357*a*, 357*b*. The first and second dowls 357*a*, 357*b* agitate the ice to keep the ice from freezing into blocks. The first end 352*a* of the agitator auger shaft 352 extends through the paddle wheel hub 359 and the paddle wheel outer body 363 and is secured to the left plates 308, 326 of the inner and outer sleeves 301, 320 by a bearing 342 in the first openings 309, 327 and a second end 352*b* of the agitator auger shaft 352 secured to right plates 310, 328 of the inner and outer sleeves 301, 320 by an agitator auger driven sprocket 370. The agitator auger shaft 352 between the first end 352*a* and the second end 352*b* has at least a first agitator auger paddle 350*a*. Between the first agitator auger paddles 350*a* and the paddle wheel hub 359, and mounted to the agitator auger shaft 352 are a spiral or helical agitator blade 354. The spiral or helical agitator blade 354 and the agitator augar shaft 352 are preferably stainless steel. The agitator auger 356 agitates and moves ice created by the ice maker 150 and stored in the ice storage bin 302. The time and frequency of the ice movement by the agitator auger 352 can be determined and set as needed to prevent ice buildup and large ice blocks forming. The agitator auger 352 preferably agitates the ice during ice vending. The agitator auger 352 is driven by an agitator auger motor 372 through an auger drive chain 374 wrapped around the agitator auger driven sprocket 370. The auger drive chain 374 is tensioned by a chain tensioner 376. The agitator auger motor 372 receives feedback from the electrical control box 125. The agitator auger 352, in addition to agitating the ice, moves the ice towards the rear ice storage bin guide 621.

The horizontal auger shaft 362 has a first end 362*a* which is secured to the left plates 308, 326 by a bearing 344 in the second openings 311, 329 and a second end 362*b* secured to right plates 310, 328 of the inner and outer sleeves 301, 320 by a horizontal auger driven sprocket 378. The horizontal auger shaft 362 has a horizontal auger paddle 360 at the first end 362*a*. Between the first and second ends 362*a*, 362*b* of the horizontal auger shaft 362 is a spiral auger blade 364. The horizontal auger 358 moves ice towards the incline auger opening 318, 336 of the inner and outer sleeves 301, 320. The horizontal auger 358 is driven by a horizontal auger motor 380 through a horizontal auger drive chain 382 via the horizontal auger sprocket 378. The horizontal auger drive chain 382 is tensioned by a chain tensioner 384. The horizontal auger motor 380 receives feedback from the electrical control box 125.

A bin access panel 300 can be removably attached to the access opening 314, 334 of the ice storage bin 302 to allow for maintenance as necessary.

Ice that flows from the auger opening 318, 336 of the ice storage bin 302 flows into an opening 275 of transfer box 252 with an outer perimeter flange 271. The outer perimeter flange 271 is coupled to the ice storage bin 302 at the auger opening 318, 336.

Figure 29:
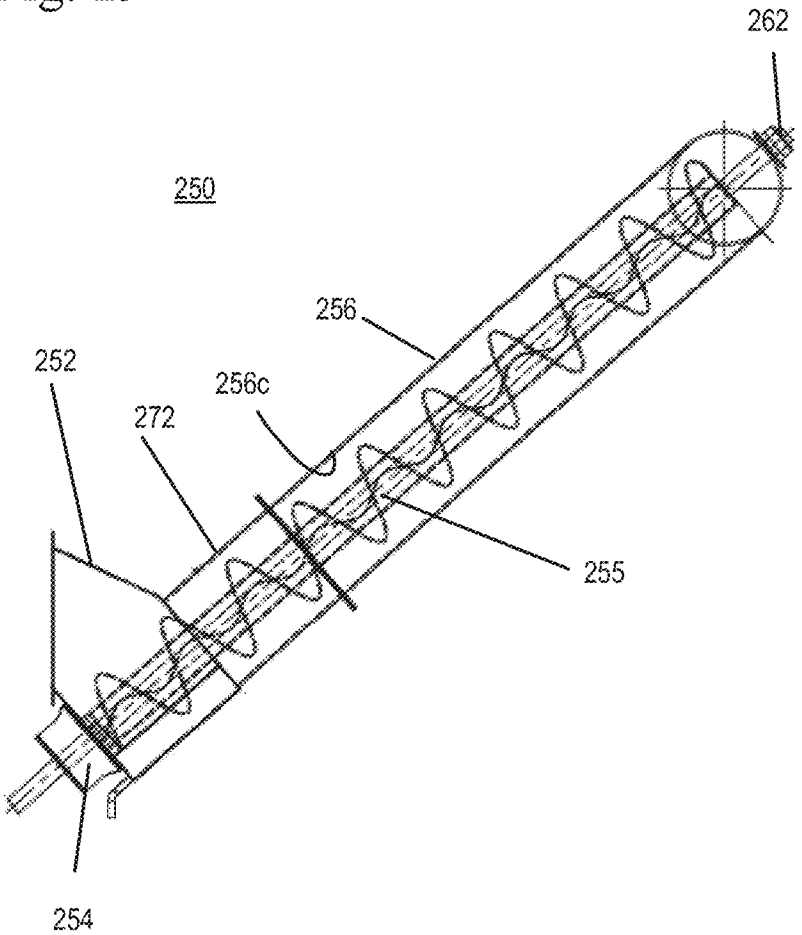
FIG. 29 shows a sectional view of the vertical/incline auger assembly.
Figure 28:
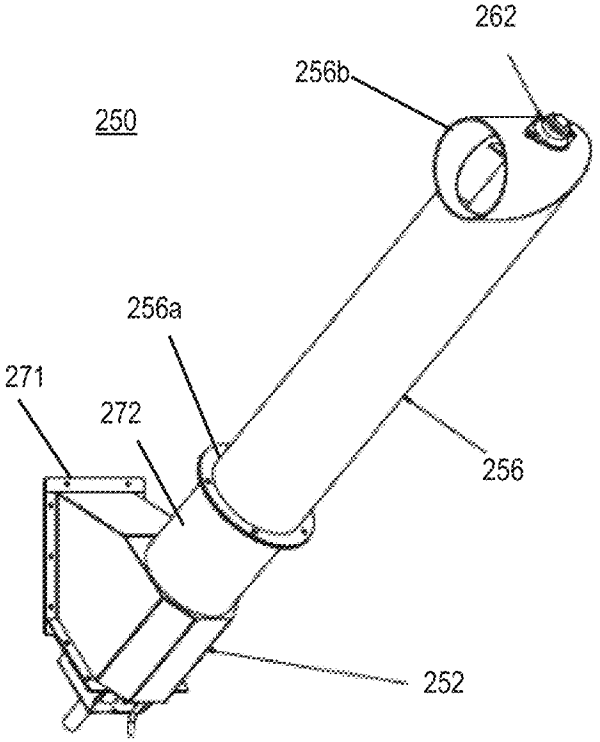
FIG. 28 shows a prospective view of a vertical/incline auger assembly.

FIGS. 28-29 show the vertical/incline auger assembly 250. A hollow pipe 256 has a first end 256*a*, a second bent end 256*b* and a hollow interior 256*c*. The second bent end 256*b* has a flange bearing 262 which attaches to the bagging mechanism 130. The first end 256*a* of the pipe 256 is received within the hollow pipe connection 272 of the transfer box 252. Within the hollow interior 256*c* is a screw conveyor 255 with blades or paddles 257 for moving ice from the transfer box 252 up to the bagging mechanism 130 to bag and dispense the ice. The screw conveyor 255 is rotated by the vertical/incline auger motor 254.

Referring to FIGS. 9-19, a staff combo bagging structure 600 is adjacent to the ice storage bin 302. The staff combo bagging structure 600 can be used by the staff of the store to fill bags of ice which are then used for sale within the store or building, separate from the vending associated with the store front outside of the building. The bagging of ice using the staff combo bagging structure 600 is a manual turn on and off operation via the electrical control box 602 for staff combo bagging structure 600.

The staff combo bagging structure 600 includes an ice bagging structure 626 mounted to a rolling rack 604 and an ice chute cabinet 610. The rolling rack 604 is preferably square or rectangular and has four sides 604*a*-604*d* with each side 604*a*-604*d* defined by ice bagging structure 626, two side rails 627 each with a first end 627*a* and a second end 627*b*, and a bottom rail 628. Each of the four sides 604*a*-604*d* additionally has casters 619 connected to the bottom rail 628.

Spanning the four sides 604*a*-604*d* of the ice bagging structure 626 is a bag base platform 614 of the ice bagging structure 626. The ice bagging structure 626 has a stack of empty bags 616, a bag weight 605 to keep the bags in place, two side panels 629*a*, 629*b* connected to and extending axially away from the door frame 616, a bag base platform 614 extending between the two side rails 627 of the rolling rack 604, and a front surface 630. The ice bagging structure 626 defines an interior 615 which receives a bag to be filled with ice. The two side panels 629*a*, 629*b* each contain a slot 607 with ice level sensors 608 to monitor for the level of ice present within the bag in the bagging interior 615.

Mounted to the front surface 630 of the ice bagging structure 626 is an ice chute cabinet 610. The ice chute cabinet 610 has a top 610*a*, a front side 610*b*, a spout access door 606, a first side 610*c*, a second side 610*d* and a hopper 610*e* with an angled guide 610*f* including an opening. The angled guide 610*f* is aligned with an opening (not shown) in the front surface 630 of the ice bagging structure 626. The ice chute cabinet 610 defines an interior 631. Attached to the rear ice storage bin opening 622 of the ice storage bin 302 is a rear ice hopper or spout 612 present within the interior 631 of the ice chute cabinet 610. The spout 612 has a rear spout opening 612*a* (see FIG. 12) to the ice storage bin 302 and a front spout opening 612*b* (see FIG. 12, 17-18) within the interior 631 of the ice chute cabinet 610. The front spout opening 612*b* of the rear ice hopper is covered by a moveable spout gate 611 with first and second panels 611*a*, 611*b*. The first panel 611*a* is connected to the second panel 611*b* via a second hinge 625.

An actuator 613 mounted within the interior 631 of the ice chute cabinet 610 moves the spout gate 611 between an open position in which ice can exit the rear ice hopper 612 into the hopper 610*e* of ice chute cabinet 610 to a closed position, preventing ice from exiting the rear ice hopper 612. More specifically, the first panel 611*a* is rotatably connected to the side 610*d* of the ice chute cabinet 610 via a first hinge 624 to allow rotation of the first panel 611*a* and the second panel 611*b* away from the front spout opening 612*b* when moved by an arm 617 of the actuator 613 connected to the second panel 611*b*. The actuator 613 may be electrically operated or may be pneumatic.

Attached to front side 610*b* of the ice chute cabinet 610 is a blower 601 for opening the bags which receive ice. The blower 601 is connected to the interior 615 of the staff combo bagging structure 600 via hose 603 passing through the ice chute cabinet 610 and the angled bottom 610*e*.

The blower 601 blows open a bag held by a bag holder (not shown) which drops into the interior space 615 of the bagging structure 626. A bag detect sensor (not shown) may be present within slot 607. The auger motors 372, 380 can start based on a timed program controlled by a controller (not shown). The bag detect sensor (not shown) determines whether a full bag of ice is present within the interior 615. It is noted that when the ice machine is auto vending through the staff combo bagger, the bag detect sensor ensures that a current bag does not keep filing until the bag has been replaced with a new bag for filling.

Ice level sensors 608 monitor the level of ice present within the bag. The ice level sensors 608 includes a transmitter to transmit electrical signals regarding the level of the ice or a simple on or off to the controller controlling the auger motors 372, 380. As soon as the ice within the bag reaches a predetermined amount, the ice level sensors 608 transmit a signal to the auger motors 372, 380 to stop.

Ice that is moved to the rear ice storage bin guide 621 by the paddles 353 of the paddle wheel 355 exits through the rear ice storage bin opening 622 to a rear ice hopper 612 via a rear ice hopper opening 612*a* between the ice chute cabinet 610 and the ice storage bin 302. When the actuator 613 opens the spout gate 611 and blower 601 blows open a bag, ice is allowed to move from the rear ice hopper 612 to the hopper 610*e* of the ice cabinet through the angled guide 610*f* to the interior 615 of the ice bagging structure 626 including the bag.

Reference Numbers

| | |
|---|---|
| 100 | ice water vending store front/customer interface |
| 101a | outer store front wall |
| 101b | outer side wall |
| 101c | outer side wall |
| 102 | outer wall trim |
| 103 | inner wall trim |
| 104 | fasteners |
| 105a | top, front bubble backlit panel |
| 105b | middle flat panel |
| 105c | bottom, front bubble backlit panel |
| 106 | LED backlight |
| 107 | vendor front back panel |
| 107a | vendor front back panel top |
| 107b | vendor front back |

-continued

| | |
|---|---|
| | panel bottom |
| 108 | opening water vending |
| 109 | insulated front wall |
| 110 | fasteners |
| 111 | bottom trim |
| 112 | coin insert (ice) |
| 113 | bill validator (ice) |
| 114 | credit card reader (ice) |
| 115 | vendor select buttons (ice) |
| 116 | coin return chute (ice) |
| 117 | vendor select buttons (water) |
| 118 | coin return chute (water) |
| 119 | water vendor payment |
| 120 | water vendor access door |
| 121 | bag chute |
| 122 | ice payment area |
| 123 | water payment box |
| 124 | water vendor |
| 125 | electrical control box |
| 126 | electrical power IN |
| 127 | electrical power OUT |
| 127b | electrical power OUT |
| 128 | water in |
| 129 | drain |
| 130 | bagging mechanism |
| 131 | refrigeration line |
| 132a | inside front wall |
| 132b | inside side wall |
| 132c | inside side wall |
| 150 | ice maker |
| 201 | channel bracket |
| 250 | vertical incline auger assembly |
| 252 | transfer box |
| 254 | incline/vertical auger motor |
| 255 | screw conveyor |
| 256 | pipe |
| 256a | first end |
| 256b | second bent end |
| 256c | hollow interior |
| 257 | blades |
| 262 | flange bearing |
| 271 | outer perimeter flange |
| 272 | hollow pipe connection incline auger |
| 275 | opening |
| 300 | bin access panel |
| 300a | access door |
| 301 | inner sleeve ice storage bin |
| 302 | complete storage bin |
| 303 | top trim inner sleeve |
| 304 | rear plate inner sleeve |
| 305 | bottom inner sleeve |
| 306 | front plate inner sleeve |
| 307 | inner sleeve opening |
| 308 | left plate inner sleeve |
| 309 | first opening inner sleeve |
| 310 | right plate inner sleeve |
| 311 | second opening inner sleeve |
| 312 | access opening flange |
| 313 | insulation |
| 314 | access opening |
| 316 | incline auger opening flange |
| 318 | incline auger opening |
| 320 | outer sleeve ice storage bin |
| 321 | outer sleeve opening |
| 322 | rear plate outer sleeve |
| 324 | front plate outer sleeve |
| 326 | left plate outer sleeve |

-continued

| | |
|---|---|
| 327 | first opening |
| 328 | right plate outer sleeve |
| 329 | second opening |
| 330 | bottom plate outer sleeve |
| 332 | top outer trim outer sleeve |
| 334 | access opening |
| 336 | auger opening |
| 342 | agitation auger bearing |
| 344 | horizontal auger bearing |
| 352 | agitator shaft |
| 352a | first end |
| 352b | second end |
| 353 | paddles |
| 353a | first planar surface |
| 353b | second planar surface |
| 354 | agitator blades |
| 355 | paddle wheel |
| 356 | agitator auger |
| 357 | dowel |
| 358 | horizontal auger |
| 359 | paddle wheel hub |
| 359a | outer circumference of paddle wheel hub |
| 360 | horizontal auger paddle |
| 361 | bore in paddle wheel hub |
| 362 | shaft |
| 362a | first end |
| 362b | second end |
| 363 | paddle wheel outer body |
| 363a | planar surface |
| 364 | auger blade |
| 370 | agitator auger driven sprocket |
| 372 | agitator auger motor |
| 374 | auger drive chain |
| 376 | chain tensioner auger drive chain |
| 378 | horizontal auger driven sprocket |
| 380 | horizontal auger motor |
| 382 | horizontal auger drive chain |
| 384 | chain tensioner horizontal auger drive chain |
| 400 | rolling bin-cabinet |
| 401 | top rack surface |
| 402 | side rails |
| 402a | first end of side rail |
| 402b | second end of side rail |
| 403a-403d | sides of rack |
| 406 | IVL cabinet roof |
| 408 | bottom rail |
| 410 | center side rail |
| 411 | bottom surface (drain pan) |
| 412 | motor shelf |
| 413 | center side rail |
| 414 | casters |
| 416 | drainage pipe |
| 550 | ice hopper |
| 552 | fixed bottom panel (fixed part of drop floor) |
| 553 | rotating bottom panel (drop floor) |
| 554 | ice level sensors |
| 555 | hinge |
| 556 | actuator |
| 557 | blower |
| 558 | bag space |
| 559 | ice bagging structure |
| 559a | side panel |

-continued

| | |
|---|---|
| 559b | side panel |
| 559c | back panel |
| 560 | bag holder |
| 561 | bag detect flap |
| 600 | staff combo bagging structure |
| 601 | blower |
| 602 | electrical control box for staff combo bagging structure |
| 603 | blower pipe |
| 604 | rolling rack for bagger |
| 604a-604d | sides of rolling rack for bagger |
| 605 | bag weight |
| 606 | spout access door |
| 607 | slot for bag sensor |
| 608 | bag sensor |
| 610 | ice chute cabinet |
| 610a | top |
| 610b | front |
| 610c | side |
| 610d | side |
| 610e | back part of hopper |
| 610f | angled bottom |
| 611 | spout gate |
| 611a | spout panel |
| 611b | spout panel |
| 612 | rear ice hopper or spout |
| 612a | rear spout opening to ice storage bin |
| 612b | front spout opening to ice chute cabinet |
| 613 | actuator |
| 614 | bag base platform |
| 615 | bagging interior |
| 616 | stack of bags |
| 617 | actuator arm |
| 618 | fastener plate |
| 619 | casters |
| 621 | rear ice storage bin guide |
| 622 | rear ice storage bin opening |
| 623 | inside area of store |
| 624 | first hinge (spout gate hinge) |
| 625 | second hinge (ice chute cabinet door hinge) |
| 626 | ice bagging structure |
| 627 | side rails |
| 628 | bottom rail |
| 629a-629b | side panels structure |
| 630 | front of bagging |
| 631 | interior of ice chute cabinet |

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An inline vending system comprising:

a) an inline vending unit received within an opening of an exterior wall of a building, the inline vending unit comprising: an insulated front wall received within the opening of the exterior wall; a vendor panel mounted to the insulated front wall; a bagging mechanism mounted to the vendor panel for vending ice, the bagging mechanism comprising: an ice hopper defined by side panels, a back panel and a fixed bottom panel and a rotating bottom panel; and a water vendor access hole defined by the vendor panel receiving a receptacle to vend water into;

b) an ice maker for generating ice;

c) an ice storage bin for receiving ice from the ice maker, the ice storage bin comprising:

an inner sleeve having an inner sleeve front panel, an inner sleeve back panel, a first inner sleeve side panel, a second inner sleeve side panel and a curved bottom, the inner sleeve defining an inner sleeve interior, wherein the inner sleeve front panel defines an inner sleeve first opening and an inner sleeve second opening and the inner sleeve back panel defines a third inner sleeve opening;

an outer sleeve comprising an outer sleeve front panel, an outer sleeve back panel, a first outer sleeve side panel, and a second outer sleeve side panel, and a bottom, the outer sleeve defining an outer sleeve interior, the outer sleeve front panel defining a first outer sleeve opening and a second outer sleeve opening and the outer sleeve back panel defining a third outer sleeve opening;

wherein the outer sleeve opening receives the inner sleeve, such that the first inner sleeve opening of the inner sleeve front panel aligns with the first outer sleeve opening of the outer sleeve front panel, the second inner sleeve opening of the inner sleeve front panel aligns with the second outer sleeve opening of the outer sleeve front panel, the third inner sleeve opening of the inner sleeve rear panel aligns with the third outer sleeve opening of the outer sleeve rear panel, and a space is generated between the inner sleeve bottom and the outer sleeve bottom;

d) an agitator auger received within the ice storage bin comprising:

a shaft having a first end and a second end;

a paddle wheel comprising a paddle wheel hub defining a bore for receiving the first end of the shaft, a plurality of paddles extending radially from paddle wheel hub; and an outer body mounted to a paddle wheel hub and perpendicular to the plurality of paddles, such that the plurality of paddles move ice towards the third inner sleeve opening and the third outer sleeve opening;

a helical blade mounted to the shaft between the first end and the second end;

a first agitator paddle mounted to the second end of the shaft;

e) a horizontal auger received within the ice storage bin comprising: a shaft having a first end and a second end; an auger paddle mounted to the second end and aligned with the second inner sleeve opening of the inner sleeve front panel and the second outer sleeve opening of the outer sleeve front panel;

f) a transfer box mounted to the second outer sleeve opening of the outer sleeve front panel comprising a body with a first opening and a second opening connected to the second outer sleeve opening; and g) a vertical/incline auger assembly coupled to the first opening of the transfer box and the bag chute; wherein ice from the ice maker passes into the ice storage bin, through the second inner sleeve opening and the second outer sleeve opening via the horizontal auger into the transfer box, through the vertical/incline auger and into a bag in the bag chute of the front panel; h) an inside bagger coupled to the third inner sleeve opening and the third outer sleeve opening; the inside bagger comprising:

an ice chute cabinet comprising: a top, a front side, a first side, a second side, an angled bottom defining an interior, wherein the second side defines an ice chute hole in communication with the ice storage bin via the third inner sleeve opening and the third outer sleeve opening;

a rear ice hopper within the interior of the ice chute cabinet surrounding the ice chute hole defining a front spout opening;

a moveable spout gate rotatably mounted to the front spout opening;

an actuator coupled to the moveable spout gate for moving the moveable spout gate from a first position which covers the front spout opening to a second position in which the front spout opening is uncovered;

a bagging structure mounted below the angled bottom of the ice chute cabinet for receiving a bag;

wherein ice from the ice storage bin is vended simultaneously or independently to the bagging mechanism vending through the front panel or vending to the inside bagger.

2. The inline vending system of claim 1, wherein the vendor panel further comprises a vendor front panel connected to a vendor bottom panel through a flat panel, wherein the vendor bottom panel comprise the bag chute and the flat panel comprises the water vendor access hole.

3. The inline vending system of claim 2, wherein a top bubble front panel is mounted to the vendor front panel and a bottom bubble front panel is mounted to the vendor back panel.

4. The inline vending system of claim 1, wherein the inside bagger is mounted to a rollable rack.

5. The inline vending system of claim 1, wherein the vending of ice to the inside bagger is manually initiated inside the building.

6. The inline vending system of claim 1, wherein the inner sleeve and the outer sleeve front panel are made of stainless steel and the outer sleeve back panel, a first outer sleeve side panel, and a second outer sleeve side panel, and a bottom are made of aluminum.

7. The inline vending system of claim 1, further comprising insulation in the space between the curved bottom of the inner sleeve and the bottom of the outer sleeve.

8. The inline vending system of claim 1, further comprising a cabinet for receiving the ice storage bin and the ice maker, the rack comprising a top surface, a bottom surface, a plurality of sides each having a first end connected to the top surface and a second end connected to a bottom surface; and a shelf connected to at least one of the plurality of sides and the bottom surface.

9. The inline vending system of claim 8, further comprising a channel bracket connecting the insulated front wall panel to the rack.

10. The inline vending system of claim 8, wherein the rack further comprises a plurality of casters mounted to the bottom surface of the rack.

11. The inline vending system of claim 8, wherein the rack is at least 32 inches from the insulated front wall panel.

12. An ice storage bin for vending ice received from an ice maker comprising:

an inner sleeve having an inner sleeve front panel, an inner sleeve back panel, a first inner sleeve side panel, a second inner sleeve side panel and a curved bottom, the inner sleeve defining an inner sleeve interior, wherein the inner sleeve front panel defines an inner sleeve first opening and an inner sleeve second opening and the inner sleeve back panel defines a third inner sleeve opening;

an outer sleeve comprising an outer sleeve front panel, an outer sleeve back panel, a first outer sleeve side panel, and a second outer sleeve side panel, and a bottom, the outer sleeve defining an outer sleeve interior, the outer sleeve front panel defining a first outer sleeve opening and a second outer sleeve opening and the outer sleeve back panel defining a third outer sleeve opening;

wherein the outer sleeve opening receives the inner sleeve, such that the first inner sleeve opening of the inner sleeve front panel aligns with the first outer sleeve opening of the outer sleeve front panel, the second inner sleeve opening of the inner sleeve front panel aligns with the second outer sleeve opening of the outer sleeve front panel, the third inner sleeve opening of the inner sleeve rear panel aligns with the third outer sleeve opening of the outer sleeve rear panel, and a space is generated between the inner sleeve bottom and the outer sleeve bottom;

an agitator auger received within the ice storage bin comprising:

a shaft having a first end and a second end;

a paddle wheel comprising a paddle wheel hub defining a bore for receiving the first end of the shaft, a plurality of paddles extending radially from paddle wheel hub; and an outer body mounted to a paddle wheel hub and having an outer body planar surface perpendicular to the plurality of paddles, wherein the outer body planar surface of the outer body and the paddles form a scoop, such that the plurality of paddles move ice towards the third inner sleeve opening and the third outer sleeve opening;

a helical blade mounted to the shaft between the first end and the second end;

a first agitator paddle mounted to the second end of the shaft;

a horizontal auger received within the ice storage bin comprising: a shaft having a first end and a second end; an auger paddle mounted to the second end and aligned with the second inner sleeve opening of the inner sleeve front panel and the second outer sleeve opening of the outer sleeve front panel;

wherein ice from the ice storage bin is vended simultaneously or independently to the second outer sleeve opening in the outer sleeve front panel and the second inner sleeve opening of the inner sleeve front panel and the third inner sleeve opening in the inner sleeve back panel and the third outer sleeve opening in the outer sleeve back opening, such that ice is vended from the ice storage bin in first direction and a second direction, with the first direction being opposite the second direction.

13. The ice storage bin of claim 12, wherein the plurality of paddles are each comprised of: a first paddle planar surface connected to an outer circumference of the paddle wheel hub and a second paddle planar surface connected to the first paddle planar surface at an angle and the outer body planar surface of the outer body.

* * * * *